United States Patent [19]

Kobayashi et al.

[11] 4,273,844

[45] Jun. 16, 1981

[54] HEAT-DEVELOPABLE PHOTOSENSITIVE MEMBER FOR FORMING ELECTROSTATIC PRINTING MASTERS

[75] Inventors: Hajime Kobayashi, Mitaka; Yasuhiro Yano, Tokyo; Ichiro Endo, Yokohama, all of Japan

[73] Assignee: Canon Kabushiki Kaisha, Tokyo, Japan

[21] Appl. No.: 932,282

[22] Filed: Aug. 9, 1978

Related U.S. Application Data

[63] Continuation of Ser. No. 761,069, Jan. 21, 1977, abandoned.

[30] Foreign Application Priority Data

Jan. 26, 1976 [JP] Japan ..... 51-7733
Jan. 26, 1976 [JP] Japan ..... 51-7742

[51] Int. Cl.[3] ..... G03G 13/14

[52] U.S. Cl. ..... 430/48; 430/49; 430/54; 430/55; 430/125; 430/353; 430/618; 430/961

[58] Field of Search ..... 96/114.1, 66 T, 48 HD, 96/67; 101/DIG. 13, 142, 426; 430/48, 54, 55, 125, 618, 961, 353, 49

[56] References Cited

U.S. PATENT DOCUMENTS

| | | | |
|---|---|---|---|
| 2,693,416 | 11/1954 | Butterfield | 96/1.5 |
| 3,074,809 | 1/1963 | Owen | 96/114.1 |
| 3,404,033 | 10/1968 | Laendle | 430/48 |
| 3,801,330 | 4/1974 | Brinckman et al. | 96/66 T |
| 3,852,066 | 12/1974 | Levy | 96/94 BF |
| 3,893,859 | 7/1975 | Burness et al. | 96/114.1 |
| 3,920,453 | 11/1975 | Gasner | 430/48 |
| 3,957,493 | 5/1976 | Masuda et al. | 96/114.1 |
| 3,997,346 | 12/1976 | Masuda et al. | 96/114.1 |
| 4,009,039 | 2/1977 | Masuda et al. | 430/49 |
| 4,036,650 | 2/1977 | Hasegawa et al. | 96/114.1 |
| 4,069,759 | 1/1978 | Endo et al. | 96/114.1 |
| 4,120,722 | 10/1978 | Okamoto et al. | 96/114.1 |
| 4,147,541 | 4/1979 | Lindblad et al. | 430/66 |

*Primary Examiner*—J. Travis Brown
*Attorney, Agent, or Firm*—Fitzpatrick, Cella, Harper & Scinto

[57] ABSTRACT

A heat-developable photosensitive member for forming an electric printing master comprises a support, an organic silver salt layer containing an organic silver salt, a halide and a toning agent dispersed in a binder, and a surface protecting layer or a particular surface, and a reducing agent is contained in at least one layer of the organic silver salt layer and a layer adjacent to the organic layer.

10 Claims, 8 Drawing Figures

HEAT-DEVELOPABLE PHOTOSENSITIVE MEMBER FOR FORMING ELECTROSTATIC PRINTING MASTERS

This is a continuation of application Ser. No. 761,069, filed Jan. 21, 1977, now abandoned.

This application is related to commonly assigned application Ser. No. 761,401, filed Jan. 21, 1977; Ser. No. 763,087, filed Jan. 27, 1977; Ser. No. 761,386, filed Jan. 21, 1977; Ser. No. 827,779, filed Aug. 25, 1977; Ser. No. 599,061, filed July 25, 1975; Ser. No. 685,460, filed May 12, 1976, now U.S. Pat. No. 4,057,016 and Ser. No. 608,006, filed Aug. 26, 1976, now U.S. Pat. No. 4,036,650.

BACKGROUND OF THE INVENTION

1. Field of the Invention

This invention relates to a heat-developable photosensitive member for forming electrostatic printing masters, and more particularly, to an improved heat-developable photosensitive member for forming electrostatic printing masters, containing an organic silver salt.

2. Description of the Prior Art

Many printing methods are known. Among them, electrostatic printing methods belong to a special class. The principle of ordinary printing is based on selective application of ink onto the surface of a printing master due to uneven surface condition of the printing master or difference in solvent affinity, and transfer of the ink to a paper by a pressing action. On the other hand, in the electrostatic printing, the ink is replaced by a heat-fixable toner which is electrostatically adhered to a printing master, then transferred to and fixed on an image-receiving sheet, e.g., paper. While the ordinary printing has such as advantage that the ink is placed uniformly and firmly on the printing master to enable a large number of sheets of paper to be printed at high speed, it has such a disadvantage that the ink is liable to adhere to portions of printing paper other than those to be printed. On the other hand, in the electrostatic printing methods, the toner can be adhered electrostatically so that firmness and uniformity of adhesion are heartily known dependent upon electrostatic "contrast" which is difficult to achieve, hence the method is not suitable for high speed printing, although staining of the printing paper as mentioned above is not so much problem as in ordinary printing. In view of the stated disadvantages, electrostatic printing has not been practically used as a clean printing method. In other words, electrostatic printing is poorer than conventional printing methods as to providing uniform and clear print in large number of sheets. For example, a representative electrostatic printing master which has been known is composed of a conductive support and an insulating image overlying the conductive support, or composed of an insulating support and a conductive image overlying on the insulating support. The image may be produced by applying an insulating or a conductive lacquer in the form of an image pattern onto the support, or by coating a photosensitive lacquer on a support, imagewise exposing and selectively removing the exposed or unexposed portions by etching. Such electrostatic printing masters have various drawbacks. For example, when it is used in the conventional electrostatic printing process sharpness of the printed image and durability of the master are usually poor. Such electrostatic printing process includes a charging step for forming an electrostatic image by selectively retaining electric charge at image portions (the image portions are insulating), a developing step, in which a toner having a polarity opposite to that of the image portions is applied, and a transfer step, in which the toner image is transferred to a receiving sheet. For example, the known electrostatic printing master has images formed on its uneven surface, and such uneven surface is damaged by mechanical abrasion during the printing process to cause irregular charging, so that durability of the master is very low. Further more, it is very difficult to obtain a high resolving power with such uneven surface type master and also technically difficult to obtain a print having high resolution. Additionally, it is difficult to obtain images of half tone or gradation with such uneven surface type master.

U.S. Ser. No. 599,061 filed July 25, 1975 discloses a novel electrostatic printing master capable of solvent the disadvantages of known electrostatic printing masters. The novel electrostatic printing master has a layer composed of an electrically insulating medium having an electric resistance sufficient to retain electrostatic charge and silver images carried therein and therefore, the surface of the master is not uneven, but smooth. Such structure of the novel master results in substantially no damage of images caused by mechanical abrasion upon printing, high durability, high resolving power due to high resolution and continuous gradation of silver image itself, and an optical density changeable depending upon an optional continuous gradation.

Usually such electrostatic printing masters having a layer containing silver images as mentioned above can be produced by imagewise exposing a silver salt photosensitive member and then developing. In particular, photosensitive members containing an organic silver salt are preferable because the silver images can be treated in a dry system and the procedure is very simple.

Such photosensitive members are so-called heat-developable photosensitive members, for example, those disclosed in U.S. Pat. Nos. 3,457,075, 3,531,286 and 3,589,903. However, those known heat-developable photosensitive members are heat-developable photosensitive members for producing a visible image as a final image directly on said members, that is, for direct copying, but do not have sufficient characteristics necessary for an electrostatic printing master. Therefore, known heat-developable photosensitive members are practically not suitable for heat-developable photosensitive members for forming electrostatic printing masters of U.S. Ser. No. 599,061.

Printing process using an electrostatic printing master is carried out, for example, by charging the master with a corona discharger to convert electric resistance patterns to electrostatic patterns, developing said electrostatic patterns with toner particles, and transferring the resulting toner images to an image receiving sheet such as paper. Therefore, an electrostatic printing master should have various characteristics such as high acceptance potential and high electrostatic charge retentivity at a portion to be electrostatically charged (a portion of a relatively high resistance), low background potential, high electrostatic potential contrast, high mechanical, electrostatic and repeating durability, excellent property of development and good cleaning property, the final image formed on a receiving sheet by transferring being sharp, high electric fatigue resistance, and high mechanical strength. In addition, there are required that the electrostatic printing master is easily and simply formed within a short time, the heat-developable photosensitive member is easily produced, the master is inexpensive, can be easily transported without any particular procedure, and can be easily distributed.

SUMMARY OF THE INVENTION

An object of the present invention is to provide a heat-developable photosensitive member for forming an electrostatic printing master capable of satisfying the above requisites and of a high commercial value.

Another object of the present invention is to provide a heat-developable photosensitive member for forming an electrostatic printing master having improved electrostatic characteristics.

Further object of the present invention is to provide a heat-developable photosensitive member for forming an electrostatic printing master having a high mechanical, electrostatic and repeating durability.

Still another object of the present invention is to provide a heat-developable photosensitive member for forming an electrostatic printing master having excellent property of development upon electrostatic printing.

Still further object of the present invention is to provide a heat-developable photosensitive member for forming an electrostatic printing master having an excellent cleaning property.

Still another object of the present invention is to provide a heat-developable photosensitive member for forming an electrostatic printing master of very low background potential and capable of giving a practically sufficient electrostatic potential contrast.

Still further object of the present invention is to provide a heat-developable photosensitive member for forming an electrostatic printing master of excellent storing property before and after the formation of images.

Still another object of the present invention is to provide a heat-developable photosensitive member for forming an electrostatic printing master having an excellent heat-developing property.

According to one aspect of the present invention, there is provided a heat-developable photosensitive member for forming an electrostatic printing master which comprises a support (A), an organic silver salt layer (B) comprising an organic silver salt (a), a halide (b) and a toning agent (c) dispersed in an electrically insulating resinous binder (d), and a surface protecting layer (C) having substantially no electrostatic charge retentivity, having a high property of development and a high cleaning property upon electrostatic printing, and directly or with an intervening layer, overlying the organic silver salt layer (B), a reducing agent (e) being contained in the organic silver salt layer (B), or at least one layer adjacent to the organic silver salt layer (B), or the organic silver salt layer (B) and at least one layer adjacent to the organic silver salt layer (B).

According to another aspect of the present invention, there is provided a heat-developable photosensitive member which comprises a support (A), an organic silver salt layer (B) comprising an organic silver salt (a), a halide (b), and a toning agent (c) dispersed in an electrically insulating resinous binder (d), and a surface of a high mechanical, electrostatic and repeating durability, a high property of development and a high cleaning property, and a reducing agent (e) being contained in the organic silver salt layer (B), or at least one layer adjacent to the organic silver salt layer (B), or the organic silver salt layer (B) and at least one layer adjacent to the organic silver salt layer (B).

According to further aspect of the present invention, the above-mentioned heat-developable photosensitive member for forming an electrostatic printing master may contain at least one member selected from a dye sensitizer, a stabilizer and a light resistant agent separately or in combination in the organic silver salt layer (B), or at least one layer adjacent to the organic silver salt layer (B), or the organic silver salt layer (B) and at least one layer adjacent to the organic silver salt layer (B).

BRIEF DESCRIPTION OF THE DRAWING

FIG. 1 shows a charging step;

FIG. 2 shows a developing step;

FIG. 3 shows a transferring step;

FIG. 4 shows a cleaning step;

DESCRIPTION OF THE PREFERRED EMBODIMENTS

Figure 1:
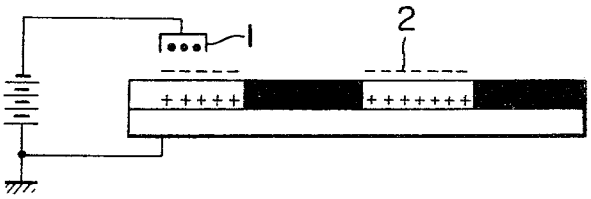
FIG. 1–FIG. 4 show an embodiment of an electrostatic printing process using a master formed from a heat-developable photosensitive member according to the present invention.

The heat-developable photosensitive member for forming an electrostatic printing master according to the present invention has typically such a structure that an organic silver salt layer overlies a support and a surface protecting layer overlies the organic silver salt layer.

The organic silver salt layer according to the present invention is usually a layer composed of an organic silver salt (a) as a main component dispersed in an electrically insulating medium.

The organic silver salt according to the present invention is a main compound contributing to supplying metallic silver for forming silver images of the electrostatic printing master.

The electrically insulating medium is selected from electrically insulating binders, has a film shapeability for forming an organic silver salt layer, and is a dispersion medium for dispersing the organic silver salt and if desired, further other components, in the organic silver salt layer. Furthermore, the electrically insulating medium serves to impart an electrostatic charge retentivity at the non-silver image portion. The electrostatic charge retentivity enables to form electrostatic latent images of a high electrostatic contrast sufficient to a practical purpose when the electrostatic printing master having silver images is charged.

The surface protecting layer is formed for the purpose of increasing a storing property before and after forming the images. The surface protecting layer contributes to prevention of degradation of the heat-developable photosensitive member to keep a constant quality during storage for a long time before forming the image, and to keeping a stable image quality after forming the image. In addition, the surface protecting layer improves electrostatic printing property, in particular, property of development and cleaning property to a great extent. Further, heat-developing property upon forming the electrostatic printing master is improved and there can be obtained a uniform image quality and an electrostatic printing master of excellent electrostatic characteristics.

The heat-developable photosensitive member for forming an electrostatic printing master according to the present invention usually has a structure that a support, an organic silver salt layer and a surface protecting layer are sequentially laminated. However, in place of the surface protecting layer, the property of such surface protecting layer may be imparted to the surface of the organic silver salt layer itself. It is preferable to provide a surface protecting layer.

To the organic silver salt layer are added a halide, a reducing agent and the like as well as an organic silver salt.

The halide is used for imparting photosensitivity to the heat-developable photosensitive member. The reducing agent serves to isolate metallic silver from the organic silver salt by reducing the organic silver salt upon heat-development for producing an electrostatic printing master.

The reducing agent may be dispersed in the organic silver salt layer as mentioned above, and alternatively the reducing agent may be provided in the organic silver salt layer in a form of a reducing agent layer formed by, for example, coating the reducing agent mixed with a film-shapable resinous binder such as cellulose acetate by using a solvent.

When the reducing agent layer has a property necessary to a surface protecting layer, it is not necessary to provide the reducing agent layer with a surface protecting layer.

In case of forming a reducing agent layer on the organic silver salt layer, it is necessary to take care that formation of electrostatic latent images does not become difficult due to uniform charging of the surface of the reducing agent caused by a large electrostatic charge retentivity of the reducing agent layer when a master is produced and charged. For the purpose of avoiding such difficulty in formation of electrostatic latent images, it is recommendable to produce the reducing agent layer in a sufficiently thin layer form, or to use a material having substantially no or little electrostatic charge retentivity as far as the purpose of the present invention can be attained, as the film-shapable binder for a reducing agent layer.

The reducing agent may be added to the organic silver salt layer or coated on the surface of the organic silver salt layer as mentioned above.

When the surface protecting layer or the surface protecting layer capable of functioning as a reducing agent layer is formed on the organic silver salt layer, it is recommendable to produce the surface protecting layer in a sufficiently thin layer form, or to use a material having substantially no or little electrostatic charge retentivity as far as the purpose of the present invention can be attained.

Thickness of the surface protecting layer is selected to satisfy the above mentioned various requisites as far as the purpose of the present invention can be attained, and is usually 0.5–15 microns, preferably 1–10 microns, more preferably 1–8 microns.

Representative organic silver salts used in the present invention are silver salts of organic acids, mercapto compounds and imino compounds and organic silver complex salts. Among them, silver salts of organic acids, in particular, silver salts of fatty acids are preferable.

Typical organic silver salts may be mentioned as shown below.

1. Silver salts of organic acids (1) Silver salts of fatty acids (1) Silver salts of saturated aliphatic carboxylic acids:

silver acetate, silver propionate, silver butyrate, silver valerate, silver caproate, silver enanthate, silver caprylate, silver pelargonate, silver caprate, silver undecylate, silver laurate, silver tridecylate, silver myristate, silver pentadecylate, silver palmitate, silver heptadecylate, silver stearate, silver nonadecylate, silver arachidate, silver behenate, silver lignocerate, silver cerotate, silver heptacosanate, silver montanate, silver melissinate, silver laccerate, and the like.

(2) Silver salts of unsaturated aliphatic carboxylic acids:

silver acrylate, silver crotonate, silver 3-hexenate, silver 2-octenate, silver oleate, silver 4-tetradecenate, silver stearolate, silver docosenate, silver behenolate, silver 9-undecynate, silver arachidonate, and the like.

(3) Silver salts of aliphatic dicarboxylic acids:

silver oxalate and the like.

(4) Silver salts of hydroxycarboxylic acids:

silver hydroxystearate and the like.

(2) Silver salts of aromatic carboxylic acids (1) Silver salts of aromatic carboxylic acids:

silver benzoate, silver o-aminobenzoate, silver p-nitrobenzoate, silver phenylbenzoate, silver acetoamidobenzoate, silver salicylate, silver picolinate, silver 4-n-octadecyloxydiphenyl-4-carboxylate and the like.

(2) Silver salts of aromatic dicarboxylic acids:

silver phthalate, silver quinolinate and the like.

(3) Silver salts of thiocarboxylic acids silver $\alpha,\alpha$-dithiodipropionate, silver $\alpha,\alpha'$-dithiodipropionate, silver thiobenzoate and the like.

(4) Silver salts of sulfonic acids silver p-toluenesulfonate, silver dodecylbenzenesulfonate, silver taurinate and the like.

(5) Silver sulfinates silver p-acetoaminobenzenesulfinate and the like.

(6) Silver carbamates silver diethyldithiocarbamate and the like.

2. Silver salts of mercapto compounds silver 2-mercaptobenzoxazole, silver 2-mercaptobenzothiazole, silver 2-mercaptobenzimidazole, and the like.

3. Silver salts of imino compounds silver 1,2,4-triazole, silver benzimidazole, silver benztriazole, silver 5-nitrobenzimidazole, silver 5-nitrobenztriazole, silver o-sulfobenzimide, and the like.

4. Organic silver complex salts silver di-8-hydroxyquinoline, silver phtharazone, and the like.

As halides (b) used in the present invention, there may be used inorganic halides and halogen-containing organic compounds. In particular, inorganic halides are preferable.

Representative halides (b) are as shown below.

(1) Inorganic halides:

Preferable inorganic halides are those having the formula $$MX_m$$

where X is halogen such as Cl, Br and I, and M is hydrogen, ammonium, or metal such as potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanium, iridium, aluminum and the like, and m is 1 when M is halogen or ammonium and a value of valency of a metal when M is the metal.

Further, silver chlorobromide, silver chlorobromoiodide, silver bromoiodide and silver chloroiodide are also preferable.

(2) Halogen-containing organic compounds:

carbon tetrachloride, chloroform, trichloroethylene, triphenyl methyl chloride, triphenyl methyl bromide, iodoform, bromoform, cetylethyl dimethyl ammonium bromide and the like.

The mechanism of function of the halides are not yet clear, but among the above-mentioned halides (b), the mechanism as to silver halides is considered as follows. Exposure causes formation of isolated silver and the resulting silver functions as developing nucleus upon heat-development and accelerates isolation of silver from the organic silver salt to produce silver images.

With respect to the halides (b) other than silver halides, such halides seem to react with the organic silver salts to produce silver halides and then silver is isolated from the silver halides in a way as mentioned above and works as developing nucleus to produce silver images.

The above mentioned halides (b) may be used alone or in combination.

It is desirable that the amount of the halide is as small as possible, provided that a minimum photosensitivity necessary to form images upon imagewise exposure, in other words, the amount of the halide is a minimum amount enough to produce developing nucleus capable of conducting heat-development.

When the halide (b) is added in an amount over the necessary amount as mentioned above, silver halides which are photosensitive remain in the material and thereby photosensitivity of the material becomes unnecessarily so high that the material should be stored or handled with an extensive care not to expose the material to even a small quantity of light. Otherwise the material is subjected to color change and so-called fog is formed.

On the contrary, when the amount of the halide is less than that necessary, there can not be formed a sufficient amount of developing nucleus for heat-developing efficiently.

Taking such limitations into consideration, the amount of the halide is usually $1-10^{-6}$ mole, preferably $10^{-1}-10^{-6}$ mole, more preferably $10^{-1}-10^{-5}$ mole per one mole of the organic silver salt.

The halide may be incorporated into the organic silver salt layer. Further the halide may be incorporated into the reducing agent layer. Still further, the halide may be incorporated into both the organic silver salt layer and the reducing agent layer. In addition, the halide may overlie the organic silver salt layer in a form of the halide layer or a layer containing the halide.

The function of the reducing agent in the present invention is described above. According to the present invention, the reducing agent is selected taking into consideration that the remaining reducing agent after a master is formed do not adversely affect electrostatic characteristics of the master.

Representative reducing agents are organic reducing agents such as phenols, bisphenols, naphthols, di- or polyhydroxybenzenes and the like.

Typical reducing agents (e) are as shown below.

(1) Phenols:

aminophenol, 2,6-di-t-butyl-p-cresol, p-methylaminophenol sulfate (metol), and the like.

(2) Bisphenols:

2,2'-methylene bis(6-t-butyl-4-methylphenol), 4,4'-butylidene bis(6-t-butyl-3-methylphenol), 4,4'-bis(6-t-butyl-3-methylphenol), 4,4'-thio bis(6-t-butyl-2-methylphenol), 2,2'-methylene bis(6-t-butyl-4-ethylphenol), and the like.

(3) Naphthols:

2,2'-dihydroxy-1,1'-binaphthyl, 6,6'-dibromo-2,2'-dihydroxy-1,1'-binaphthyl, bis(2-hydroxy-1-naphthyl) methane, methylhydroxynaphthalene, and the like.

(4) Di- or polyhydroxybenzenes:

hydroquinone, methylhydroquinone, chlorohydroquinone, bromohydroquinone, pyrogallol, catechol and the like.

(5) Others:

1-phenyl-3-pyrazolidone (phenidone) and the like.

Other than the above-mentioned reducing agents, according to the present invention, for the purpose of improving heat-developing property and electrostatic characteristics of the resulting electrostatic printing master, there may be used a bis-naphthol reducing agent represented by bis-$\beta$-naphthol such as 2,2'-dihydroxy-1,1'-binaphthyl and the like disclosed in Japanese Patent Laid Open Nos. Sho 46-6074 and U.S. Pat. No. 3,751,249. Further, for the purpose of increasing the relative speed of heat-development, increasing the maximum density (Dmax), suppressing the minimum density (Dmin) and increasing exposure latitude, there may be used the above-mentioned bis-naphthol reducing agent together with 1,3-dihydroxybenzene such as 2,4-dihydroxybenzaldehyde, 2,4-dihydroxybenzophenone, 2,4-dihydroxyacetophenone, 2',4'-dihydroxy-4-methylbenzophenone, 2,4-dihydroxypropiophenone, 2,4-dihydroxybutylphenone. Further, for the purpose of improving the developing temperature latitude, there may be used a sulfonamidophenol reducing agent disclosed in U.S. Pat. No. 3,801,321 a compound disclosed in British Pat. No. 1,441,223 and Sho British Pat. No. 1,441,223 having the formula

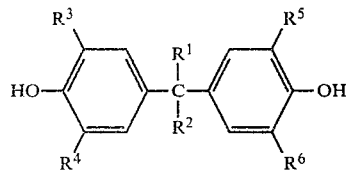

where $R^1$ and $R^2$ are alkyl of $C_{1-9}$, $R^1$ and $R^2$ may be taken together to form a ring such as cycloheptane ring, cyclohexane ring and the like, $R^1$ may be hydrogen, and $R^3$, $R^4$, $R^5$ and $R^6$ are selected from hydrogen, alkyl of $C_{1-12}$, cycloalkyl such as cyclopentyl, cyclohexyl and the like, and phenyl; ester compounds disclosed in Japanese Patent Laid Open No. Sho 50-147711 such as an ester compound of the formula

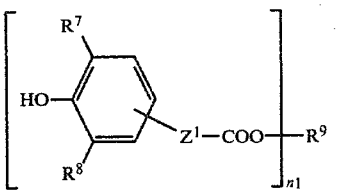

where $R^7$ is alkyl of $C_{1-20}$, $R^8$ is hydrogen or alkyl similar or dissimilar to $R^7$, $Z^1$ is a divalent group having not more than 30 carbon atoms, $R^9$ is an alcohol residue or phenol residue, n is a natural number not exceeding number of hydroxy group of the alcohol or phenol molecule, as produced from a carboxylic acid compound derived from a substituted phenol having a bulky substituent at the ortho position and mono- or polyhydric alcohol or phenol, an ester compound of the formula

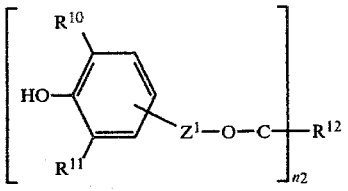

where $R^{10}$, $R^{11}$, $Z^1$ are similar to $R^7$ and $R^8$ as above, $R^{12}$ is a carboxylic acid residue, $n_2$ is a natural number not exceeding basicity of the carboxylic acid, as produced from an alcohol derived from a substituted phenol having a bulky substituent at the ortho position and a mono- or polycarboxylic acid.

Typical reducing agents are listed in Table 2 below.

The above mentioned reducing agents may be used in combination as far as such combination does not adversely affect each of the reducing agents and other components.

The amount of the reducing agent (e) is appropriately determined depending upon the desired characteristics of the heat-developable photosensitive material. Usually it is not more than 5 moles, preferably not more than one mole, more preferably $1-10^{-5}$ mole per mole of the organic silver salt.

As components contained in the heat-developable photosensitive member for forming electrostatic printing master, there are an organic silver salt (a), a halide (b) and a reducing agent (e) as mentioned above. Further, there may be added a toning agent (c) for controlling tone of the image, a stabilizer (g) for imparting stability to images when stored for a long time, a light resistant agent (h) for preventing fog caused by light during storing the heat-developable photosensitive member before forming the master and preventing change of image caused by fog with the lapse of time after forming the master, a dye sensitizer (f), a development accelerator (i) upon forming the master and the like in accordance with the desired characteristics of the heat-developable photosensitive member for forming an electrostatic printing master.

A toning agent (c) used in the present invention is selected from toning agents which have the above mentioned effects and further give metallic silver in such an aggregation state that metallic silver aggregates uniformly and densely in the volume direction (in the direction of thickness) when isolated from the organic silver salt (a) upon heat-development. By using such toning agent (c) as above, the resulting dense aggregation of metallic silver particles in the direction of thickness contributes to lowering effectively the electric resistance at the exposed portions (silver image portions) to produce an electrostatic printing master having excellent electrostatic characteristics. As the result, the images on a printed matter produced by using the electrostatic printing master are excellent in resolving power, tone reproduction and sharpness.

Representative toning agents (d) are: phthalazinone or a compound disclosed in Japanese Patent Laid Open No. Sho 49-5019 having the formula

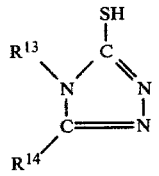

where $R^{13}$ is hydrogen, alkyl or

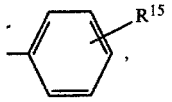

$R^{14}$ is alkyl or

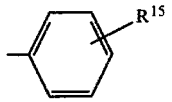

where $R^{15}$ is hydrogen, amino or

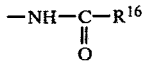

where $R^{16}$ is alkyl; a compound disclosed in Japanese Patent Laid Open No. Sho 49-5020 having the formula

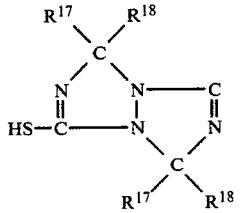

where $R^{17}$ and $R^{18}$ are selected from hydrogen, alkyl and phenyl; compounds disclosed in British Pat. No. 1,462,016 having the formulas

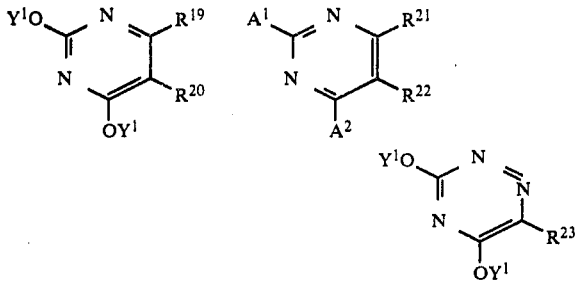

where $A^1$ and $A^2$ are different and are selected from amino and $—OY^1$, $Y^1$ is hydrogen or ion of alkali metal, silver, mercury and gold, $R^{19}$ and $R^{20}$ are selected from hydrogen, halo such as chloro, bromo, iodo and the like, alkyl of $C_{1-4}$, alkoxy of $C_{1-4}$, benzyl, allyl, acyl, and phenyl, $R^{21}$, $R^{22}$, $R^{23}$ are selected from hydrogen, halo such as chloro, bromo, iodo and the like, and alkyl of $C_{1-4}$; a compound disclosed in U.S. Pat. No. 3,951,660 having the formula

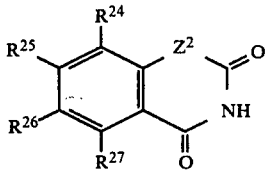

where $Z^2$ is —O— or $—NCH_2—CH(CH_3)_2$, $R^{24}$–$R^{27}$ are selected from hydrogen, alkyl of $C_{1-4}$, cyclopentyl, cyclohexyl, methoxy, hydroxy, dimethylamine, diethylalkyl, chloro, bromo and an atom group necessary to form a benzene ring; a phthalazinone compound disclosed in Japanese Patent Laid Open No. Sho 49-22928 having the formula

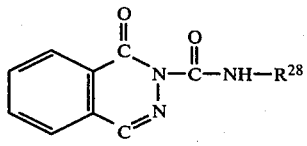

where $R^{28}$ is substituted alkyl including alkoxy substituted alkyl, and alkoxycarbonyl substituted alkyl, alkenyl, cycloalkyl, aralkyl, phenyl, naphthyl, biphenyl, heterocyclic group, and aliphatic or aromatic acyl; a cyclohexyl substituted isocyanate derivative of phthalazinone as disclosed in Japanese Patent Laid Open No. Sho 49-102329; a reducing agent including 2-pyrazoline-5-one and cyclic imides and/or quinazoline having the formula

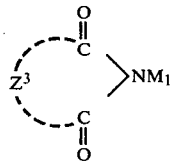

where $Z^3$ is selected from atoms necessary to form a heterocyclic ring, $M_1$ is hydrogen, hydroxy, silver, mercury, potassium, sodium or gold disclosed in U.S. Pat. No. 3,846,136; a reducing agent composed of a mixture of imidazole and at least one member selected from phthalic acid, naphthalic acid and phthalamic acid disclosed in U.S. Pat. No. 3,847,612; particularly a compound of the formula

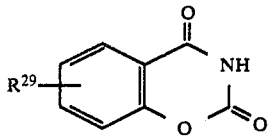

where $R^{29}$ is hydrogen, hydroxy, nitro, alkyl of $C_{1-4}$, methoxy, phenyl, acetoamido, chloro, bromo or iodo, effective to an organic silver salt such as silver laurate and silver caprate disclosed in U.S. Pat. No. 3,885,967; a compound of the formula

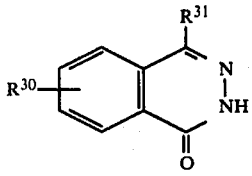

where $R^{30}$ is halo such as chloro, bromo and the like, alkyl of $C_{1-4}$, alkoxy of $C_{1-4}$, nitro, amino or hydroxy, $R^{31}$ is hydrogen, chloro, bromo, alkyl or alkoxy of $C_{1-4}$, phenyl, 1-naphthyl, 2-naphthyl, halogenoalkyl or hydroxyalkyl of $C_{1-4}$, aminoalkyl, dimethylaminomethyl, dimethylaminoethyl, benzyl, phenethyl, alkoxyarylalkyl such as p-methoxybenzyl and the like, morpholino substituted alkyl of $C_{1-4}$, halogenophenyl, $C_{1-4}$ alkyl substituted phenyl, phenyl having a $C_{1-4}$ alkyl substituted amino, β-styryl, 2-(3-pyridyl) vinylidene group or 2-(2-pyridyl) vinylidene group, disclosed in Japanese Patent Laid Open No. Sho 50-67132; and 2,3-dihydro-1,4-phthalazinedione of the formula

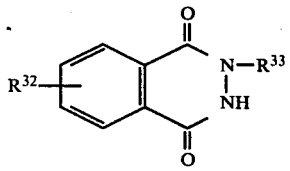

where $R^{32}$ is hydrogen, chloro, bromo, alkyl of $C_{1-4}$, phenyl, naphthyl, $C_{1-4}$ alkyl or alkoxy substituted amino, thioalkoxy of $C_{1-18}$ or acylamido of $C_{1-4}$, and $R^{33}$ is hydrogen, phenyl, naphthyl, pyridyl, 2-(2-pyridyl)ethyl, 2-(4-pyridyl)ethyl, benzoyl or methyl, disclosed in Japanese Patent Laid Open No. Sho 50-67641.

Representative toning agents (c) are as shown in Table 1 (infra).

The toning agents may be used in combination as far as such combination does not adversely affect one another and other components of the heat-developable photosensitive member according to the present invention.

Amount of the toning agent (c) may be optionally selected depending upon the desired characteristics of the heat-developable photosensitive member. Usually the amount is not more than 5 moles, preferably $5–10^{-5}$ mole, more preferably $1–5\times10^{-5}$ mole per one mole of the organic silver salt (a).

Representative stabilizers (g) are as shown below:

4-aryl-1-carbamoyl-2-tetrazoline-5-thione disclosed in Japanese Patent Laid Open No. Sho 50-105129 having the formula

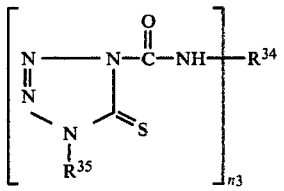

where $R^{34}$ is alkyl of $C_{1-12}$ or aryl of $C_{6-12}$, $R^{35}$ is aryl of $C_{6-12}$, and $n_3$ is an integer of 1 or 2;

a compound disclosed in Japanese Patent Laid Open No. Sho 50-119624 of the formula

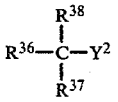

where $R^{36}$, $R^{37}$, and $R^{38}$ are selected from hydrogen, alkyl, aryl, nitro, alkylcarboxy, arylcarboxy,

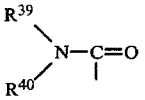

where $R^{39}$ and $R^{40}$ are selected from hydrogen, alkyl, aryl, and amido, $R^{41}$—$SO_2$— where $R^{41}$ is alkyl or aryl, and $Y^2$ is halogen;

a compound disclosed in U.S. Pat. No. 3,874,946 having the formula

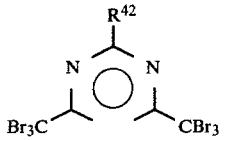

where $R^{42}$ is alkyl of $C_{1-6}$;

a compound disclosed in U.S. Pat. No. 4,021,250 having the formula

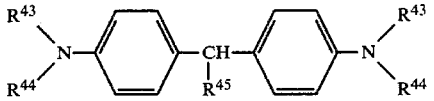

where $R^{43}$ and $R^{44}$ are selected from alkyl, aralkyl, and methanesulfonamidoethyl, $R^{45}$ is hydrogen, alkyl, chloroanilino, benzyloxy, or 2-oxo-1-(N-phenylcarbamoyl)-propyl;

a compound of the formula

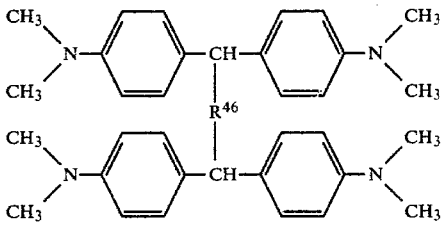

-continued where $R^{46}$ is 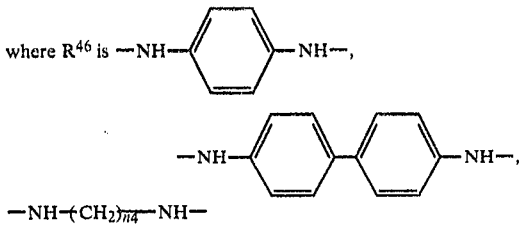

where $n_4$ is 1–5;

a compound of the formula

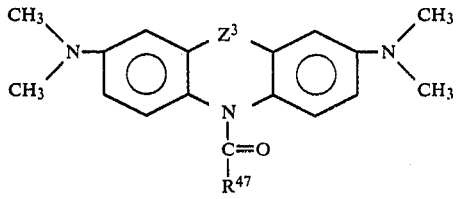

where $R^{47}$ is aryl, 3-pyridyl or 2-thienyl, $Z^3$ is S, O, or NH;

photosensitive halogen-containing organic oxidizing agents disclosed in U.S. Pat. No. 3,707,377 such as tetrabromobutane, hexabromocyclohexane, tribromoquinaldine and the like;

N-halogen succinimide disclosed in Japanese Patent Laid Open No. Sho 49-10724;

N-halogenamide disclosed in U.S. Pat. No. 3,957,493;

a compound disclosed in Japanese Patent Laid Open No. Sho 49-97613 having the formula

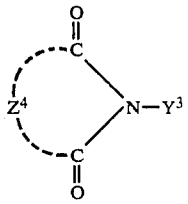

where $Z^4$ is selected from atom groups necessary for forming a heterocyclic ring containing at least two nitrogen atoms and $Y^3$ is halogen;

a mixtue of a substituted phthalazinone (disclosed in Japanese Patent Laid Open No. Sho 50-67132) and a sulfonic acid and salt thereof having the formula $$R^{48}—SO_2Y^4$$

where $R^{48}$ is alkyl or substituted alkyl of $C_{6-22}$, phenyl, or naphthyl, and $Y^4$ is alkali metal ion, alkaline earth metal ion or ammonium ion as disclosed in Japanese Patent Laid Open No. Sho 50-123331; and compounds disclosed in Japanese Patent Laid Open No. Sho 47-318 having the formulas

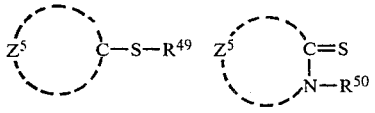

where $Z^5$ is selected from atom group necessary to form a 5- or 6-membered heterocyclic ring, $R^{49}$ is alkyl of $C_{1-10}$ or aryl,

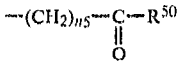

or a heterocyclic group, where $R^{50}$ is

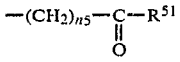

where $n_5$ is 0 or 2 and $R^{51}$ is alkyl of $C_{1-5}$, aryl of $C_{6-12}$ or furoyl.

The stabilizers (g) may be used in combination as long as the combination does not affect adversely one another and other components of the heat-developable photosensitive member.

Amount of the stabilizer (g) may be selected optionally dependent upon the desired characteristics of the heat-developable photosensitive member. It is usually $2-10^{-7}$ mole, preferably $1-10^{-6}$ mole, more preferably $10^{-1}-10^{-5}$ mole per one mole of the organic silver salt (a).

Representative light resistant agents (h) are as shown below:

mercapto and thioketone organic compounds having the formulas, respectively

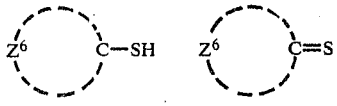

where $Z^6$ is selected from atom groups necessary for forming a 5- or 6-membered ring, of indene, imidazole, triazole, tetrazole, thiazole, oxazole, benzimidazole, benzothiazole, benzotriazole, thiadiazole, oxadiazole, pyridine, pyrimidine, pyrazine, pyridazine or the like series as disclosed in Japanese Patent Laid Open No. Sho 50-77034;

compounds disclosed in Japanese Patent Laid Open No. Sho 50-156425 such as indene, imidazole, triazole, tetrazole, thiazole, oxazole, benzimidazole, benzothiazole, benzotriazole, thiadiazole, oxadiazole, pyridine, pyrimidine, pyrazine, pyridazine and the like series compounds;

benzenesulfonic acid, p-toluenesulfonic acid, tetrabromophthalic acid, and tetrabromophthalic anhydride as disclosed in Japanese Patent Laid Open No. Sho 49-125016 effective to silver laurate and silver caprate;

silver salts of a thione compound of the formula

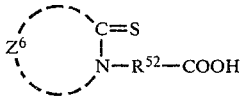

where $R^{52}$ is alkylene of $C_{1-10}$ and $Z^6$ is an atom group necessary for forming a heterocyclic 5-membered ring, disclosed in Japanese Patent Laid Open No. Sho 49-52626.

The light resistant agents (h) may be used in combination unless the combination adversely affects one another and other components of the heat-developable photosensitive member.

Amount of the light resistant agent (h) may be optionally selected depending upon the desired characteristics of the heat-developable photosensitive member for electrostatic printing members. It is usually $2-10^{-7}$ mole, preferably $1-10^{-6}$ mole, and more preferably $10^{-1}-10^{-5}$ mole per one mole of the organic silver salt (a).

Examples of stabilizers (g) and light resistant agents (h) are shown in Table 4 (infra).

Representative dye sensitizers (f) are as shown below:

quinoline dyes disclosed in Japanese Patent Laid Open No. Sho 49-84637;

dye disclosed in U.S. Pat. No. 3,870,523 of the formulas $$R^{53}-N=N-R^{54}$$

$$R^{55}-N=N-R^{56}-N=N-R^{57}$$

where $R^{53}$–$R^{55}$ and $R^{57}$ are selected from aryl such as phenyl, α-naphthyl, β-naphthyl and the like, $R^{56}$ is arylene such as phenylene, biphenylene, naphthylene and the like, $R^{53}$–$R^{57}$ may be substituted groups, and at least one of $R^{53}$ and $R^{54}$ and at least one of $R^{55}$–$R^{57}$ have $SO_3M^1$ or $COOM^1$ as a substituent where $M^1$ is hydrogen, alkali metal, alkaline earth metal or $NH_4$;

compounds disclosed in Japanese Patent Laid Open No. Sho 49-102328 having the formulas

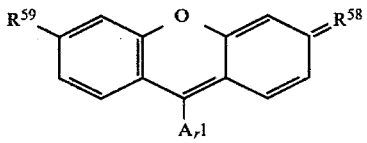

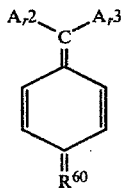

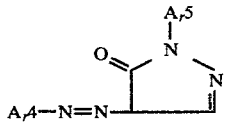

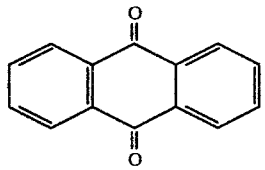

where $R^{58}$ and $R^{60}$ are selected from =O and

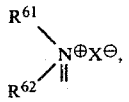

$R^{59}$ is $-OM^2$ or

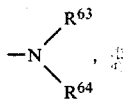

$A_r1$–$A_r5$ are aryl, $R^{61}$–$R^{64}$ are selected from alkyl and aryl, $M^2$ is hydrogen, alkali metal, alkaline earth metal or $-NH_4$, and $X^{\ominus}$ is anion;

a compound disclosed in U.S. Pat. No. 3,877,943 having the formula

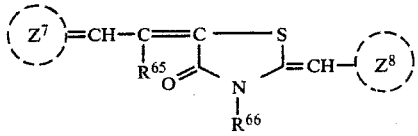

where $R^{65}$ and $R^{66}$ are selected from hydrogen, alkyl, and phenyl, and $Z^8$ and $Z^7$ are monovalent and divalent atom-groups necessary for constituting a 5- or 6-membered heterocyclic ring, respectively;

a compound disclosed in Japanese Patent Laid Open Nos. Sho 50-2924 and Sho 50-29029 having the formula

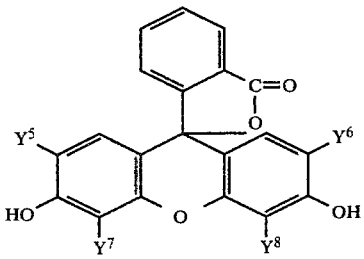

where $Y^5$ and $Y^6$ are selected from hydrogen, halogen such as chloro, bromo, iodo and the like, and alkyl of $C_{1-4}$, $Y^7$ and $Y^8$ are selected from hydrogen and halogen such as chloro, bromo, iodo and the like, when $Y^5$ and $Y^6$ are hydrogen, $Y^7$ and $Y^8$ are substituents other than hydrogen, and when $Y^7$ and $Y^8$ are hydrogen, $Y^5$ and $Y^6$ are substituents other than hydrogen;

compounds disclosed in Japanese Patent Laid Open No. Sho 50-104637 having the formulas

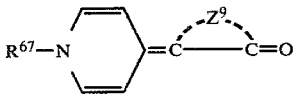

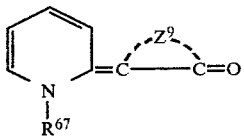

where $R^{67}$ is alkyl of $C_{1-4}$ or aryl, $Z^9$ is an atom group necessary for constituting rhodanine, thiohydantoin, or 2-thio-2,4-oxazolidinedione nucleus;

compounds disclosed in Japanese Patent Laid Open No. Sho 50-105127 having the formulas

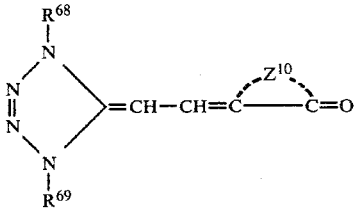

-continued

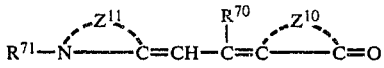

where $R^{68}$ and $R^{69}$ are selected from alkyl of $C_{1-4}$, alkenyl of $C_{2-4}$, aryl of $C_{6-12}$, carboxyalkyl of $C_{2-5}$, carboxyaryl of $C_{7-15}$, sulfoalkyl of $C_{1-4}$, and sulfoaryl of $C_{6-14}$, $R^{70}$ is carboxyalkyl of $C_{2-4}$ or carboxyaryl of $C_{7-14}$, $R^{71}$ is an aliphatic group such as alkyl of $C_{1-8}$, $Z^{10}$ is an atom group necessary for constituting rhodanine, thiohydantoin, or 2-thio-2,4-oxazolidinedione nucleus, $Z^{11}$ is an atom group necessary for constituting a heterocyclic ring of benzimidazole, thiazoline, benzothiazole or benzoxazole series;

merocyanine dyes having a pyrazolone nucleus as an acidic nucleus disclosed in Japanese Patent Laid Open No. Sho 50-156424;

halogenated polymethine dyes disclosed in Japanese Patent Laid Open No. Sho 47-5478;

merocyanine dyes disclosed in U.S. Pat. No. 3,764,322 having the formula

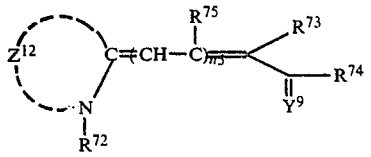

where $R^{72}$ is a saturated or unsaturated aliphatic group, cycloalkyl, or aryl, $R^{73}$ is CN, $COR^{76}$, $CON(R^{76})_2$, or $COOR^{76}$, $R^{74}$ is $R^{76}$, $OR^{76}$, or $N(R^{76})_2$, $R^{73}$ and $R^{74}$ may be taken together to form a carbon ring or a heterocyclic ketomethylene ring, $R^{75}$ is hydrogen, alkyl of $C_{1-4}$, hydroxy, alkoxy of $C_{1-4}$, or phenyl, $R^{76}$ is an aliphatic group of $C_{1-6}$, $Y^9$ is oxygen or sulfur, $n_5$ is 0, 1 or 2, $Z^{12}$ is an atom group necessary for constituting a 5- or 6-membered heterocyclic ring;

neutro styryl dyes disclosed in U.S. Pat. No. 3,764,321;

polymethylene dyes disclosed in Japanese Patent Laid Open No. Sho 48-28221; and merocyanine dyes disclosed in U.S. Pat. No. 3,761,279 having rhodanine, thiohydantoin, or 2-thio-2,4-oxazolidinedione nucleus.

Typical dye sensitizers (f) as mentioned above are shown in Table 5 (infra).

The dye sensitizers may be used in combination unless the combination adversely affects one another and other components of the heat-developable photosensitive member.

Amount of the dye sensitizer may be optionally selected depending upon types of the components such as organic silver salt (a), halide (b) and the like and sensitizability of the dye sensitizer (f). It is preferably $1-10^{-6}$ mole and more preferably $10^{-1}-10^{-5}$ mole per mole of the organic silver salt (a).

In addition to above-mentioned additives such as toning agent (c), dye sensitizer (f), stabilizer (g) and light resistant agent (h), there may be added a development accelerator (i) for the purpose accelerating the developing speed at exposed portion upon heat-development and facilitating aggregation of metallic silver particles.

The development accelerators (i) are, for example, benzophenones having hydroxy and/or alkoxy substituent on the benzene ring and further any other development accelerators may be used as far as they serves to accelerate development in the present invention.

Amount of the development accelerator (i) may be optionally selected depending upon the desired purpose. It is usually $2-10^{-7}$ mole, preferably $1-10^{-6}$ mole, and more preferably $10^{-1}-10^{-5}$ mole per one mole of the organic silver salt (a).

The structure of heat-developable photosensitive member for forming an electrostatic printing master is fundamentally that an organic silver salt layer (B) overlies a support (A) and a surface protecting layer (C) overlies the organic silver salt layer (B) and if desired, a reducing agent layer is interposed between the organic silver salt layer (B) and the surface protecting layer (C).

When an organic silver salt layer (B) is the uppermost layer, the surface of the organic silver salt layer (B) is subjected to a treatment for imparting the function of a surface protecting layer (C). The reducing agent layer may be treated so as to impart the function of a surface protecting layer (C).

Preferable structures are a structure comprising a support (A), an organic silver salt layer (B), and a surface protecting layer (C) laminated sequentially, and a structure comprising a support (A), an organic silver salt layer (B) and a reducing agent layer having a function of a surface protecting layer (C) laminated sequentially.

The above-mentioned additives such as toning agent (c), stabilizer (g), light resistant agent (h), dye sensitizer (f) and development accelerator (i) are preferably added to the organic silver salt layer (B) according to a usual structure. They may be added to the organic silver salt layer (A), and further the reducing agent layer or the surface protecting layer (C). Further, a light resistant agent (h) may be added only to the surface protecting layer (C) or the reducing agent layer.

A light resistant agent (h) is preferably added to the uppermost layer of the heat-developable photosensitive member when said member is composed of a multiple layer. Each of the above-mentioned components may be formed into each different layer. However, at least components (b), (c) and (f) are preferably dispersed uniformly in the organic silver salt layer (B).

A material for the surface protecting layer is selected from materials achieving the purpose of the present invention. Usually the material for the surface protecting layer is a material capable of forming a thin film (film-shapeability), retaining substantially no electrostatic charge or hardly retaining electrostatic charge, being not adversely affected by heating upon heat-development and which does not disturb chemical reactions occurring in the organic silver salt layer upon forming images. Further it is desirable that the material can enhance the storing property of the heat-developable photosensitive member before forming the master and the image stability after forming the master. Still further, it is desirable that the material can effectively protect the organic silver salt layer from developing agents and cleaning procedure upon electrostatic printing and the material is excellent in property of developing and cleaning property.

In particular, for the purpose of enhancing cleaning property, there may be added to the surface protecting layer fluorine resins such as tetrafluoroethylene resins, trifluorochloroethylene resins, tetrafluoroethylenehexafluoropropylene copolymer resins, fluorinated vinylidene resins and the like and fluorine resins, kaoline, silicon dioxide, molybdenum disulfide, fluorinated graphite and the like lubricant powder.

The following materials may be used as a material for forming the surface protecting layer. Table 6 (infra) discloses preferable materials.

Polyvinylchloride, polyvinyl acetate, vinyl chloride-vinyl acetate copolymer, polyvinyl butyral, polystyrene, polymethyl methacrylate, polyurethane rubber, xylene resin, benzyl cellulose, ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate, cellulose acetate propionate, gelatine derivatives, acrylamide polymer, chlorinated rubber, polyisobutylene, butadiene-styrene copolymer, polyvinyl alcohol and the like. Further photocurable resins such as urethanated acryls are preferable because photocurable resins can be coated of the surface of the photosensitive material by, for example, dipping and cured by irradiating with light and thereby the surface protecting layer is easily produced.

The organic silver salt layer may be produced by dispersing the organic silver salt in an electrically insulating resinous binder by using a solvent and coating the resulting dispersion on the support. The coating procedure may be carried out by known techniques for producing a thin film from a synthetic resin such as rotating coating methods, air-knife coating methods, wire-bar coating methods, flow-coating methods and the like. The thickness of the layer may be optionally controlled in accordance with the purpose.

Representative electrically insulating resinous binders are as shown below:

polyvinyl butyral, polyvinyl acetate, cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinyl methyl ether, styrene-butadiene copolymer, polymethyl methacrylate and the like. These binders may be used alone or in combination.

It is preferable to select a sufficiently electrically insulating binder.

Amount of the binder may be optionally selected so as to impart an electrostatic printing master a practically sufficient electrostatic charge retentivity at the non-silver image portions.

The amount of the binder in the organic silver salt layer is usually 0.02–20 parts by weight, preferably 0.1–5 parts by weight per one part by weight of the organic silver salt (a).

As the solvents for dispersing the organic silver salt in an electrically insulating medium, there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The support may be a metal plate such as aluminum, copper, zinc, silver and the like, a metal laminate paper, a paper treated to prevent permeation of a solvent, a paper treated with a conductive polymer, a synthetic resin film containing a surface active agent, a glass paper, synthetic resin, a film such as cellulose acetate film, polyethylene terephthalate film, polycarbonate film, polystyrene film and the like having on the surface a vapor-deposited metal, metal oxide or metal halide. Further, there may be used an insulating glass, paper, synthetic resin and the like. In particular, a flexible metal sheet, paper or other conductive materials which can be wound on a drum are preferable, when the final electrostatic printing master is to be used in a form wound on a drum.

Where the surface of a non-conductive support such as synthetic resin film, paper and the like is provided with a conductive layer, the conductive layer may be formed optionally on either the surface facing the organic silver salt layer or the surface opposite to the surface on which the organic silver salt layer is mounted, but where the conductive layer directly contacts the organic silver salt layer, it is preferable to select a conductive layer forming material which does not react with the organic silver salt.

As the conductive layer forming material, there is preferably used a liquid agent for imparting electroconductivity composed of a conventional agent for imparting electroconductivity and an appropriate resin dispersed in a solvent. Some examples thereof are listed in Table 7 (infra).

Such liquid agent for imparting electroconductivity is usually coated on a surface of a paper such as an art paper, a coat paper and the like.

Where a conductive support is employed, any conductive support may be used which has a specific resistance less than that at non-silver image portions when the electrostatic printing master is produced, i.e. a specific resistance of not higher than $10^9$ ohm·cm, preferably not higher than $10^5$ ohm·cm, and does not react with the organic silver salt.

Electric resistance of each of layers formed on the organic silver salt layer is controlled so that electrostatic charge is not retained when the member is made into a master. The control may be effected by adjusting the thickness of layer or selecting an appropriate material for the layer.

Thickness of the heat-developable photosensitive member is optionally determined depending upon the purpose, use and durability of the member. Among layers mounted on the support, thickness of the organic silver salt layer is usually 1–50 microns and preferably 2–30 microns.

The heat-developable photosensitive member is imagewise exposed to produce latent images at the exposed portions and then subjected to a developing procedure to produce silver images and thereby an electrostatic printing master is formed.

The electrical resistivity (or specific resistance) of the non-silver image portion of the master is determined so that it can retain sufficiently electrostatic charges to a practical extent for electrostatic printing. The specific resistance $\rho_1$ of the silver image portion is also determined so that sufficient electrostatic contrast can be formed between the silver image portion and the non-silver image portion, to the extent that trouble-free electrostatic printing can be carried out. The specific resistance $\rho_1$ may be $10^{13}$ ohm·cm or less, more preferably $10^{10}$ ohm·cm or less.

On the other hand, the specific resistance $\rho_2$ of the non-silver image portion may be $10^{11}$ ohm·cm or more, more preferably $10^{14}$ ohm·cm or more.

However, for the purpose of forming a sufficiently practical electrostatic contrast, it is necessary to determine the value of the specific resistance $\rho_1$ so as to be less than that of the specific resistance $\rho_2$, by preferably $10^2$ ohm·cm or more.

The most fundamental electrostatic printing process using a master for electrostatic printing according to the present invention comprises charging the master to form an electrostatic latent image thereon, developing the latent image and transferring the developed image to an image-receiving sheet. However, in a cyclic process, when the electrostatic latent image is already present on the surface of the master, the charging step may be omitted, and alternatively when a charging-transfer method is adopted in the transferring step, the above-mentioned charging step should be conducted only in the first cycle; in the subsequent recycle process, it may be omitted.

Further, when the electrostatic printing master is prepared from a heat developable photosensitive member, the steps for such purpose, that is, the imagewise exposure and heat development can be incorporated into the electrostatic printing process as the preparative step, and therefore, it becomes possible to attain a continuous process. If necessary, other additional steps, for example, cleaning and fixing steps, may be incorporated into the electrostatic printing process at the time of putting the fundamental process into practice. In addition, as stated below, the fundamental process may be carried out in various ways.

Figure 2:
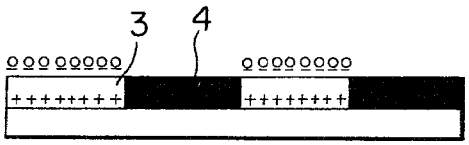
Figure 3:
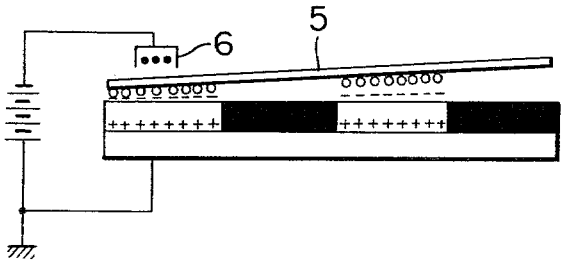
Figure 4:
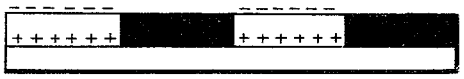

The most fundamental electrostatic printing process is illustrated in FIGS. 1–4. As shown in FIG. 1, a master bearing a silver image is caused to pass under, for example, a negative corona electrode 1 so that negative charges 2 can be formed on the surface region having no silver image, that is, non-silver image portion of the master. In this case, either a positive corona electrode or an alternating current corona electrode may be used in place of the negative corona electrode,and a contact electrode may be utilized in place of the corona electrode. As the result of the above-mentioned charging, a latent image of the electrostatic charges is selectively formed on the region having no silver image in the master. Such latent image of the electrostatic charges is subjected to a toner treatment in a usual manner, for example, cascade, magnetic brush, liquid, Magne-dry and wetting developments as shown in FIG. 2. If the toner particles are electrically conductive and charges are not particularly imparted thereto, or if they have charges opposite to those of the image of the electrostatic charges, they adhere to a portion 3 to which charges are imparted. On the other hand, if the same charges as those of the image are imparted to the toner particles, the particles adhere to a portion 4 to which charges are not imparted. As shown in FIG. 3, an image-receiving material 5 is brought into contact with the surface of the toner image and the toner image can be transferred to the image-receiving material 5 by using, for example, a corona electrode 6 of the opposite polarity to that of the toner from the back side of the image-receiving material 5. The toner image thus transferred can be fixed by technique conventionally known in the art. Usually, heating fixation, solvent fixation and the like are employed. In case that liquid development is carried out, it is sufficient to heat merely the toner image. Besides, pressure-fixation method may be adopted. Subsequently, if necessary, the surface of the master may be cleaned by using a cleaning means such as a brush, a fur brush, cloth, a blade and the like to remove the remaining toner image as shown in FIG. 4.

Figure 5:
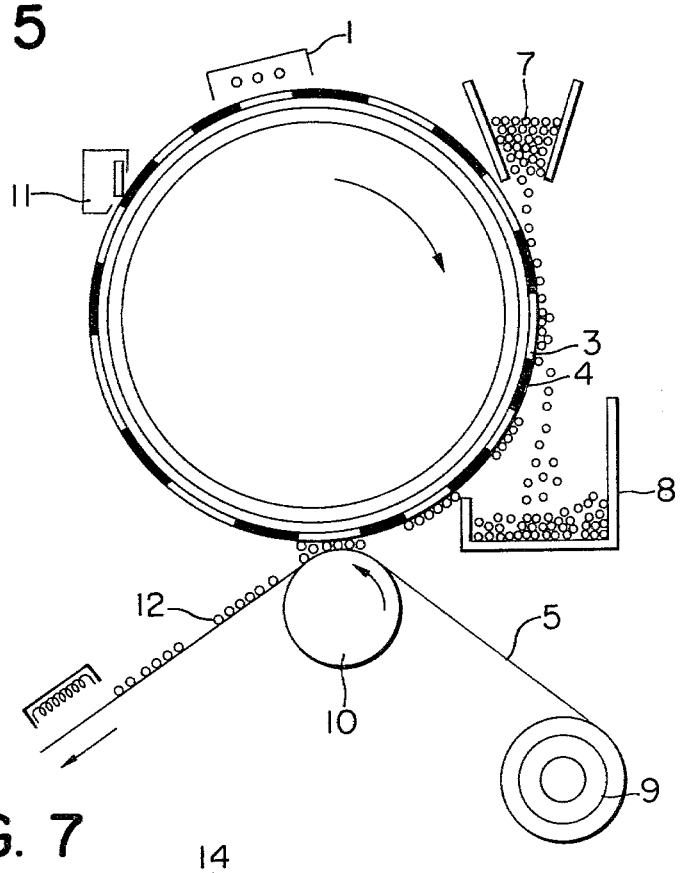
FIG. 5 shows diagrammatically an apparatus carrying out the process comprising steps of FIG. 1–FIG. 4.

For the purpose of repeating the process as illustrated in FIG. 1–FIG. 4 at a high speed, as shown in FIG. 5 a process comprising charging, developing, transferring and cleaning steps may be carried out, or a process of developing, transferring and cleaning may be repeated by utilizing the durability of the formed electrostatic latent images. The cleaning step may be omitted, if desired. The electrostatic printing master is wound on a drum, rotated to the direction of the arrow, charged by corona electrode 1 and then subjected to cascade development with toner 7.

Thus, toner particles selectively attach electrostatically to non-image portions 3 where electrostatic charge is present. The toner particles not attaching to said portions are recovered in vessel 8. The developed toner images are transferred to an image-receiving sheet 5 fed from paper-feeding roller 9 by using transferring roller 10. The transferring roller may be charged by an electric field having a polarity opposite to that of the toner charge, if desired. The toner image transferred 12 is fixed by a heater to produce an electrostatically printed matter. The electrostatic printing master is cleaned by a means for cleaning (blade cleaning) 11 after the toner image is transferred.

Various processes other than the above mentioned process may be employed. Some of them are shown in FIG. 6–FIG. 8 below.

Figure 6:
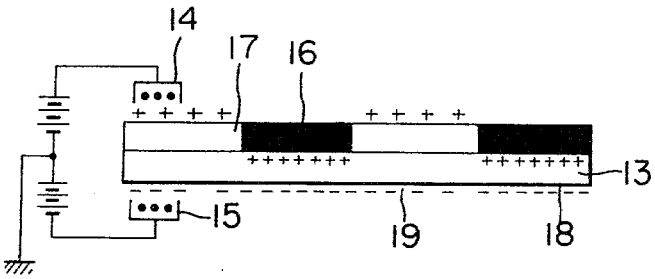
FIG. 6–FIG. 8 show other embodiments carrying out electrostatic printing.

FIG. 6 illustrates an embodiment in which support 13 of an electrostatic printing master is of insulating property and the electrostatic printing master is subjected to double corona charging by corona electrodes 14 and 15, the polarities of which are selected so as to be opposite to each other. Owing to the charging, in the non-silver image portion (unexposed portion) 17, electrostatic charges are imparted to both sides of the electrostatic printing master, in case of which the polarity of the charges on one side of the master is opposite to that of the charges on the other side. On the other hand, in the silver image portion (exposed portion) 16, the electrostatic charges imparted by the corona electrode 14 reach the interface between the silver image portion 16 and the support 13 through the silver image portion 16 and charged there since the silver image is electrostatically conductive. As the result, the silver image portion retains a large amount of the electrostatic charges through the support as compared with the non-silver image portion depending upon the difference in the electrostatic capacity between the silver image portion and the non-silver image portion which results from the difference in the interval for retaining charges between both portions. Consequently, the electrostatic charges are retained on the support surface 18 corresponding to the silver image portion in a higher density while they are retained on the support surface 19 corresponding to the non-silver image portion in a lower charge density so that an electrostatic image is formed. On the other hand, in the upper surface of the electrostatic printing master, the electrostatic charges are retained only on the non-silver image portion 17, thereby forming an electrostatic image. The latter electrostatic image and that formed on the support surface are in relation of positive-negative with respect to the electrostatic contrast. The electrostatic image formed on the upper surface of the electrostatic printing master is developed with the toner having the opposite polarity to that of the electrostatic image to give a positive visible image, whereas it is developed with the toner having the same polarity as that of the electrostatic image to give a negative visible image although the contrast is deteriorated. On the other hand, the electrostatic image formed on the surface of the support is developed with the toner having the opposite polarity to that of the electrostatic image to give a negative visible image, whereas it is developed with the toner having the same polarity as that of the electrostatic image to give a positive visible image although the contrast is decreased. In case of the development with the toner having the same polarity as that of the electrostatic image, the electric potential of the toner is determmined so that the electrostatic image to be developed may be sufficiently visualized. Needless to say, as the charging means, those other than the corona electrode may be optionally used as mentioned above.

Figure 7:
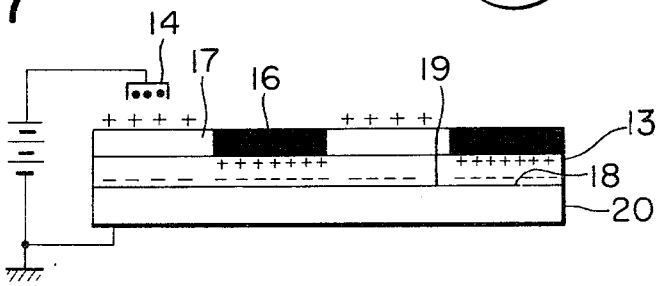

FIG. 7 illustrates one of the examples of other charging means, in which a charging electrode 20 is provided on the surface of the support 13 in place of the corona electrode 15 as in FIG. 6. The charging electrode 20 may be previously formed integrally with the electrostatic printing master or it may formed in another way. Further, it may be in the type of such a drum as shown in FIG. 5. The charging electrode may be removed after the charging.

Figure 8:
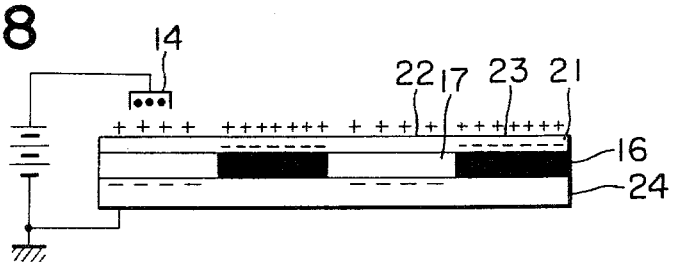

FIG. 8 illustrates other embodiment of the electrostatic printing process of the present invention using an electrostatic printing master having an electro-conductive support 24 and being provided with an insulating layer 21. The electrostatic printing master is charged by means of the corona electrode 14. As the result, the electrostatic charges on the non-silver image portion 17 (unexposed portion) are retained on both the portion 22 of the insulating layer 21 and the interface between the non-silver image portion and the support, whereas the electrostatic charges on the silver image portion 16 (exposed portion) are retained on both the portion 23 of the insulating layer 21 and the interface between the insulating layer and the silver image portion. The non-silver image portion is small in the electrostatic capacity due to the long distance for retaining the electrostatic charges, and therefore the charge density of the non-silver image portion is small. On the other hand, the charge density of the silver image portion is large since its electrostatic capacity is large due to the short distance for retaining the electrostatic charges. As the result, an electrostatic image having a contrast in which a small amount of the electrostatic charges is retained on the non-silver image portion and a large amount thereof is retained on the silver image portion is formed on the surface of the insulating layer 21. The formed electrostatic image is developed with the toner having the opposite polarity to that of the electrostatic charges of the image to give a negative visible image while it is developed with the toner having the same polarity as that of the electrostatic image to give a positive visible image. In case of the development with the toner having the same polarity as that of the image, the electric potential of the toner is determined in order that it may adhere selectively to the non-silver image portion. Needless to say, in the embodiment of FIG. 8, other charging means may be optionally adopted as in the case of FIG. 6. The insulating layer may be previously formed integrally with the electrostatic printing master, or it may be formed in other optional manners. This embodiment is useful and effective in that the insulating layer can function also as a protection layer.

In the embodiments illustrated in FIGS. 6–8, the developed visible image, i.e. the toner image is transferred onto the transfer material as shown in FIG. 3, and if necessary, the electrostatic printing master is then subjected to cleaning treatment, and subsequently, the charging-developing-transferring steps are repeated. When the difference in the electrostatic capacity between the non-silver image portion and the silver image portion is utilized to form an electrostatic image as in the embodiments shown in FIGS. 6–8, the thickness of the insulating layer and the silver image-bearing layer is determined in order that the contrast of the electrostatic image may be more than a practical level.

TABLE 1

| No. | Toning Agents<br>Name or structural formula by compound |
|---|---|
| 1 | 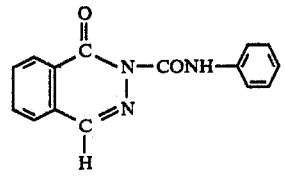 |
| 2 | 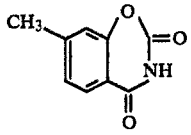 |
| 3 | 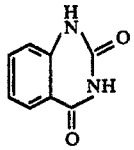 |
| 4 | 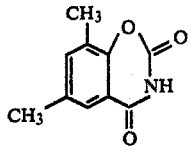 |
| 5 | 2,3-dihydro-1,4-phthalazinedione |
| 6 | 2,3-dihydro-5-hydroxy-1,4-phthalazinedione |
| 7 | 4-(1-naphthyl) phthalazinone |
| 8 | 6-chlorophthalazinone |
| 9 | 5,7-dimethoxyphthalazinone |
| 10 | 1,3-benzoxazine-2,4-dione |
| 11 | 8-methyl-1,3-benzoxazine-2,4-dione |
| 12 | 6-phenyl-1,3-benzoxazine-2,4-dione |
| 13 | 3-methyl-2-pyrazoline-5-one |
| 14 | N-hydroxysuccinimide |
| 15 | 1-phenylurazol |
| 16 | phthalimide |
| 17 | quinazoline |
| 18 | succinimide |
| 19 | 3-phenyl-2-pyrazoline-5-one |
| 20 | 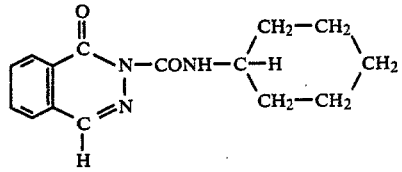 |
| 21 | 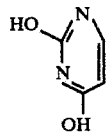 |

TABLE 1-continued

Toning Agents

| No. | Name or structural formula by compound |
|---|---|
| 22 | 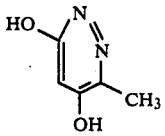 |
| 23 | 3-mercapto-5-methyl-4-phenyl-1,2,4-triazole |
| 24 | 4-ethyl-3-mercapto-5-phenyl-1,2,4-triazole |
| 25 | 5-p-acetamidophenyl-4-ethyl-3-mercapto-1,2,4-triazole |
| 26 | 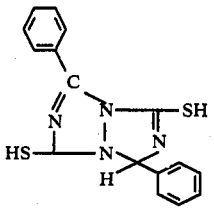 |
| 27 | 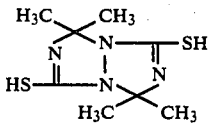 |

TABLE 2

Typical Reducing Agents

| No. | Name or structural formula of compound |
|---|---|
| 28 | 2,2'-dihydroxy-1,1'-binaphthyl |
| 29 | bis-(2-hydroxy-1-naphthyl) methane |
| 30 | 6,6'-dimethoxy-2,2'-dihydroxy-1,1'-binaphthyl |
| 31 | 2,4-dihydroxybenzaldehyde |
| 32 | 2', 4'-dihydroxy-4-methylbenzophenone |
| 33 | 4-(methylsulfonamido) phenol |
| 34 | 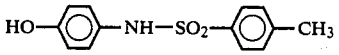 |
| 35 | 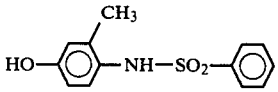 |
| 36 | 4-(n-butylsulfonamido) phenol |
| 37 | 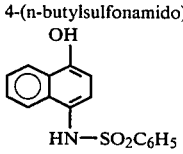 |
| 38 | 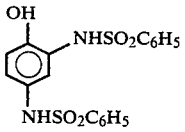 |
| 39 | 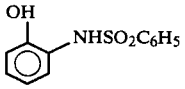 |
| 40 | 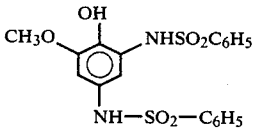 |
| 41 | 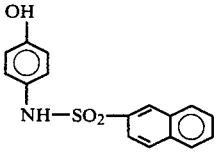 |

TABLE 2-continued

Typical Reducing Agents

| No. | Name or structural formula of compound |
|---|---|
| 42 | 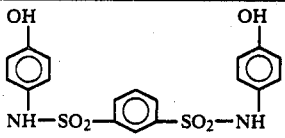 |
| 43 | 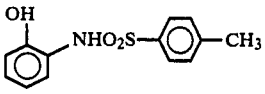 |
| 44 | 2,2'-bis-(4-hydroxy-3-methyl-phenyl)-propane |
| 45 | 2,2'-bis-(4-hydroxy-3-isoprophy-phenyl)-propane |
| 46 | 1,1'-bis-(4-hydroxy-3-methylphenyl)-3-methylcyclohexane |
| 47 | 2,2'-bis-(4-hydroxy-3-t-butyl-5-methylphenyl) propane |
| 48 | 4,4'-butylidene-bis-(2-methylphenol) |
| 49 | 4,4'-benzylidene-bis-(2-t-butylphenol) |
| 50 | 4,4'-benzylidene-di (o-cresol) |
| 51 | 4,4'-(p-bromobenzylidene)-diphenol |
| 52 | 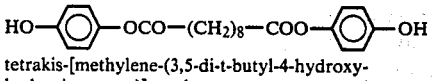 |
| 53 | tetrakis-[methylene-(3,5-di-t-butyl-4-hydroxy-hydrocinnamato)] methane |
| 54 | 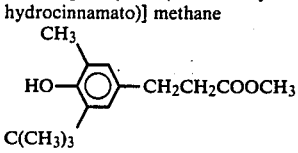 |

TABLE 3

Representative Halides

| Name of compound |
|---|
| calcium chloride |
| barium chloride |
| calcium iodide |
| strontium iodide |
| strontium bromide |
| magnesium bromide |
| N-bromacetamide |
| cetyl ethyl dimethyl ammonium bromide |

TABLE 4

Examples of Stabilizers and Light Resistant Agent

| No. | Name or structural formula of compound |
|---|---|
| 63 | 5-acetyl-4-methyl-2-(3-oxobutylthio) thiazole |
| 64 | 4-furoyl-3-methylthio-1,2,4-thiadiazole-5-thione |
| 65 | 2,6-di-t-butyl-4-(1-phenyl-5-tetrazolyl) thiophenol |
| 66 | 5-acetyl-4-methyl-3-(3-oxobutyl) thiazoline-2-thione |
| 67 | 4-phenyl-1-phenylcarbamoyl-2-tetrazoline-5-thione |
| 68 | N,N'-hexamethylenebis (1-carbamoyl-4-phenyl-2-tetrazoline-5-thione) |
| 69 | hexabromobutane |
| 70 | 1, 2, 3, 4-tetrabromobutane |
| 71 | sodium benzenesulfinate |
| 72 | sodium p-toluenesulfinate |
| 73 | α-bromo-γ-nitro-β-phenylbutyrophenone |
| 74 | 2-bromo-2-phenylsulfonylacetamide |
| 75 | 2-bromo-2-nitro-1,3-propanediol |
| 76 | 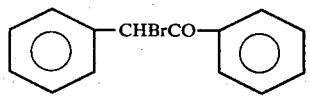 |
| 77 | 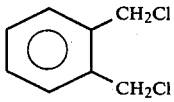 |
| 78 | 2-tribromomethylsulfonyl benzothiazole |

TABLE 4-continued

Examples of Stabilizers and Light Resistant Agent

| No. | Name or structural formula of compound |
|---|---|
| 79 | 2,4-bis (tribromomethyl)-6-methyl triazine |
| 80 | 2-mercaptobenzothiazole |
| 81 | 1-phenyl-5-mercaptotetrazole |
| 82 | 2-mercaptobenzimidazole |
| 83 | 5-nitrobenzotriazole |
| 84 | silver 3-(2-carboxyethyl)-4-hydroxymethyl-4-thiazoline-2-thionate |
| 85 | 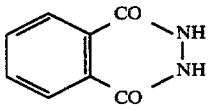 |
| 86 | 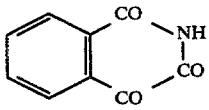 |
| 87 | 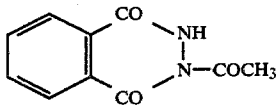 |
| 88 | 4,4'-tetraethyldiaminodiphenylmethane |
| 89 | 10-benzoyl-3, 7-bis (dimethylamino) phenothiazine |
| 90 | tetrabromophthalic acid |
| 91 | benzenesulfonic acid |
| 92 | N-bromosuccinimide |
| 93 | N-iodosuccinimide |
| 94 | N-bromoacetamide |
| 95 | N-chloroacetamide |
| 96 | 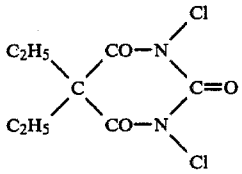 |
| 97 | 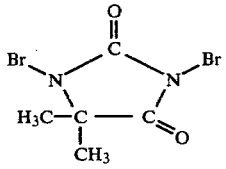 |

TABLE 5

Typical Dye Sensitizers

| No. | Name or structural formula of compound |
|---|---|
| 98 | 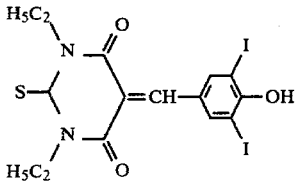 |
| 99 | 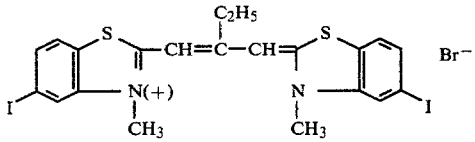 |
| 100 | 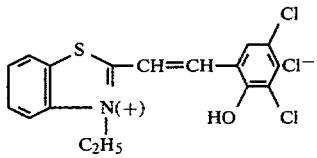 |

TABLE 5-continued

Typical Dye Sensitizers

| No. | Name or structural formula of compound |
|---|---|
| 101 | 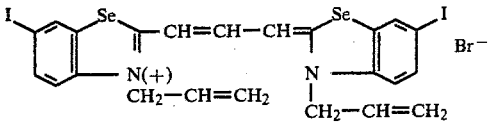 |
| 102 | 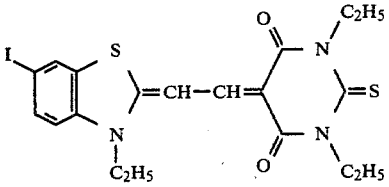 |
| 103 | 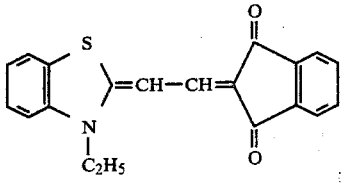 |
| 104 | 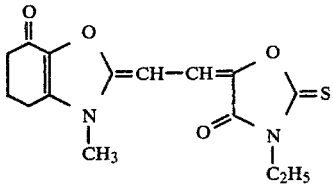 |
| 105 | 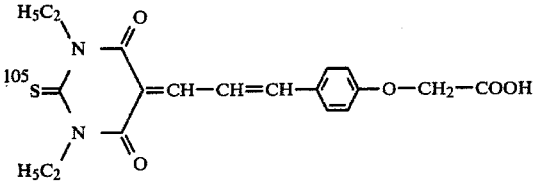 |
| 106 | 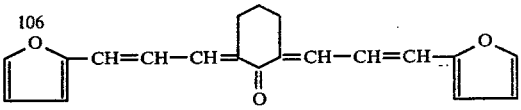 |
| 107 | 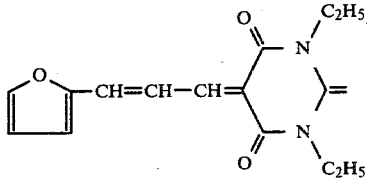 |
| 108 | 4-(p-dimethylaminostyryl) quinoline |
| 109 | 2-(p-dimethylaminostyryl)-6-dimethylaminoquinolinium ethyl iodide |
| 110 | 4-(p-dimethylaminophenylazo) quinoline |
| 111 | 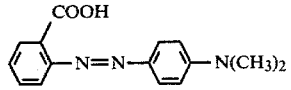 |
| 112 | 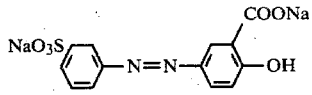 |
| 113 | 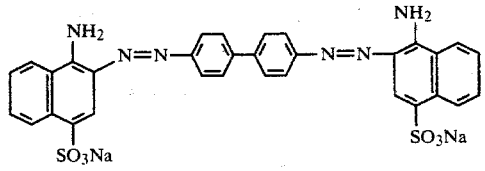 |

TABLE 5-continued
Typical Dye Sensitizers
| No. | Name or structural formula of compound |
|---|---|
| 114 | 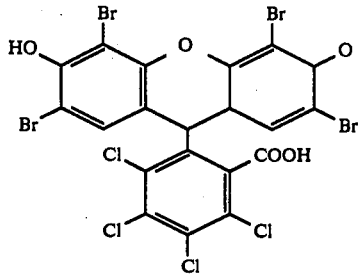 |
| 115 | 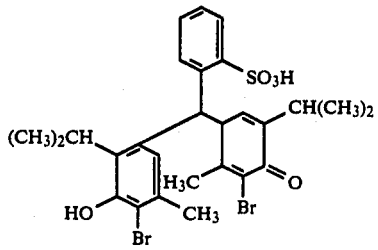 |
| 116 | 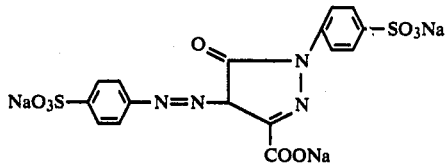 |
| 117 | 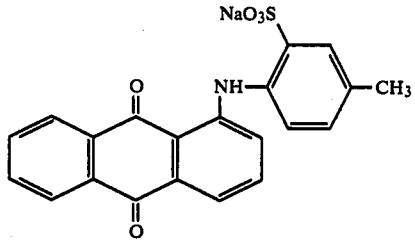 |
| 118 | 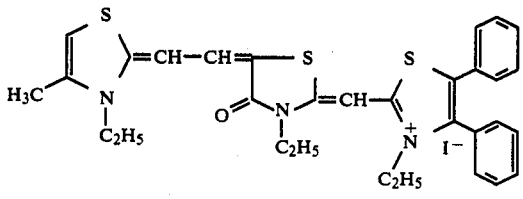 |
| 119 | 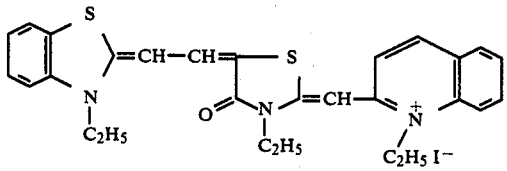 |
| 120 | 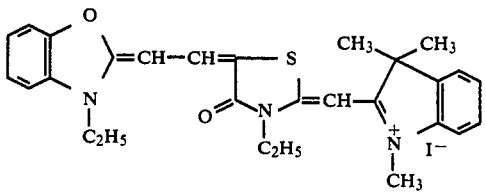 |
| 121 | 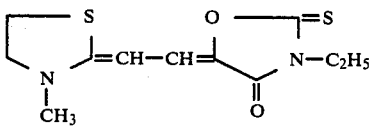 |
TABLE 5-continued
Typical Dye Sensitizers
| No. | Name or structural formula of compound |
|---|---|
| 122 | 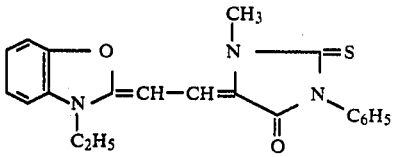 |
| 123 | 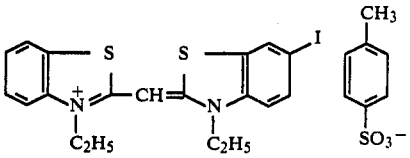 |
| 124 | 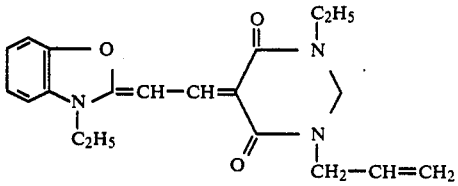 |
| 125 | 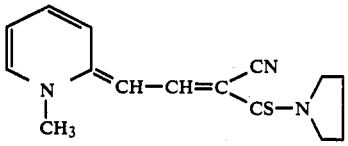 |
| 126 | 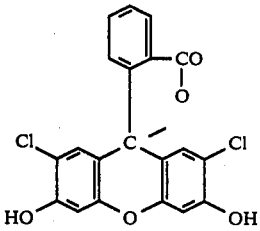 |
| 127 | 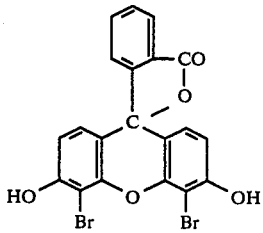 |
| 128 | 3-p-carboxyphenyl-5-[β-(3-ethyl-2(3)-benzoxazolylidene) ethylidene]rhodanine |
| 129 | 3-carboxymethyl-5-[(3-methyl-2(3H)-thiazolinylidene) isopropylidene] rhodanine |
| 130 | 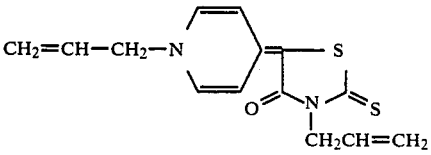 |
| 131 | 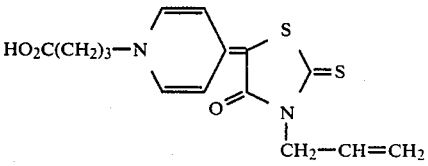 |

TABLE 5-continued

Typical Dye Sensitizers

| No. | Name or structural formula of compound |
|---|---|
| 132 | 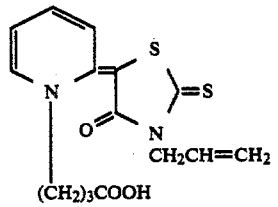 |
| 133 | 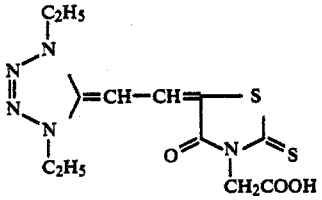 |
| 134 | 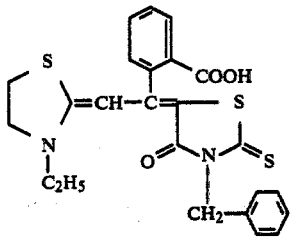 |
| 135 | 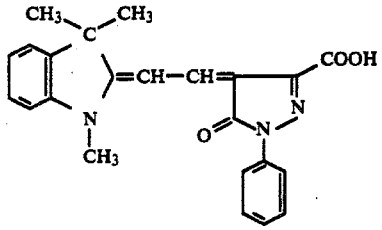 |
| 136 | 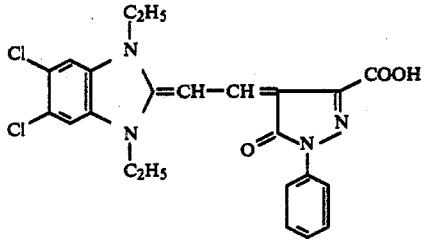 |

TABLE 6

Materials For Forming Surface Protecting Layer

| No. | Polymer solution |
|---|---|
| 137 | polystyrene (10 wt.% solution in methyl ethyl ketone) |
| 138 | cellulose acetate (10 wt.% solution in acetone) |
| 139 | polyvinyl chloride (5 wt.% solution in tetrahydrofuran) |
| 140 | ethyl cellulose (10 wt.% solution in methyl ethyl ketone) |
| 141 | polyvinyl butyral (10 wt.% solution in ethyl alcohol) |
| 142 | polystyrene (10 wt.% solution in methyl ethyl ketone) 100 g.<br>kaoline 5 g.<br>(The kaoline is dispersed in the polystyrene solution) |
| 143 | 10 g. of kaoline dispersed in 100 g. of a 10 wt.% solution of polyvinylbutyral in ethyl alcohol |
| 144 | 10 g. of silicon dioxide dispersed in 100 g. of a 10 wt.% solution of cellulose diacetate in acetone |
| 145 | 10 g. of silicon dioxide dispersed in 100 g. of a 15 wt.% solution of xylene resin in tetrahydrofuran |

TABLE 7

Conductive Layer Forming Material

| No. | Electroconductivity imparting agent |
|---|---|
| 146 | a mixture of the following components:<br> 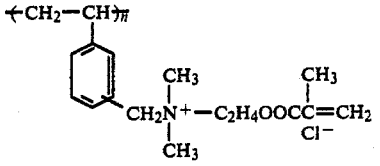 2 parts by weight<br>polyvinylbutyral 5 parts by weight<br>ethyl alcohol 100 parts by weight |
| 147 | 10% solution of Oligo Z-M-1010 (trade name, supplied by Tomoegawa Seishisho K.K., Japan) in methanol<br>an electroconductive oligomer of an anionic sulfonic acid salt series. |
| 148 | 50% solution of PQ-50B (trade name, supplied by Soken Kagaku Kogyo K.K., Japan) in methanol<br>a cationic acrylic polymer having a viscosity of 5-15. |
| 149 | A mixture of the following components:<br> 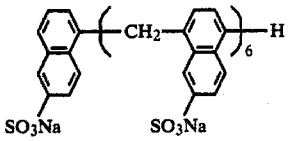 3 parts by weight<br>water 10 parts by weight |
| 150 | A mixture of the following components:<br>copolymer of methylenebisacrylamide and styrenesulfonic acid ammonium salt (contents of the methylenebisacrylamide being 2.0 molar %) of the formula<br> 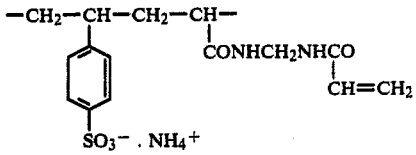 30 parts by weight<br>starch 10 parts by weight<br>water 150 parts by weight |
| 151 | A 10% solution of poly (4-vinylpyridine)-iodine complex in ethyl alcohol |
| 152 | A 10% solution of a complex of polycation of the formula<br> 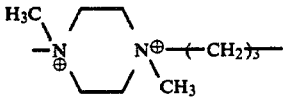 <br>and TCNQ in formamide |

TCNQ is tetracyanoquinodimethane.

The invention will be understood more readily by reference to the following examples. However, these examples are intended to illustrate the invention and are not to be construed to limit the scope of the invention.

[Reference Example for the preparation of a master]

25 g. of silver behenate, 120 g. of methyl ethyl ketone and 120 g. of toluene were mixed and dispersed for 72 hours or more by the ball milling method. Then, 100 g. of polyvinyl butyral (10 wt.% ethyl alcohol solution) was added to the mixture and sufficiently mixed until the mixture became uniform. Further, to the polymer dispersion liquid containing an organic silver salt thus prepared, 200 mg. of calcium bromide, 120 mg. of mercury acetate and 2.5 g. of phthalazinone were added and mixed. This polymer dispersion liquid was coated and dried onto an art paper in the thickness of 8μ after drying by a coating rod at a dark place to form an organic silver salt layer.

On the other hand, 1.5 g. of 2,2'-methylene-bis-(6-t-butyl-p-cresol), 0.3 g. of phthalazinone, 10 g. of cellulose acetate (10 wt.% acetone solution) and 30 g. of acetone were mixed to prepare an over-coating layer-forming solution. This solution was coated onto the foregoing organic silver salt layer in the thickness of 4μ after drying at a dark place to prepare a heat-developable photosensitive material for producing an electrostatic printing master.

The photosensitive material was exposed to a tungsten light source (2500 lux) through a positive image for 12 seconds. Thereafter, the heat development was carried out by using a roller type heating device at 130° C. for two seconds to obtain a negative print visible image so that an electrostatic printing master was prepared.

EXAMPLE 1

25 g. of 50 mol% silver behenate*1, 120 g. of methyl ethyl ketone and 120 g. of toluene were mixed and dispersed for 72 hours or more by the ball milling method.

Note: (*1) What is meant by 50 mol% silver behenate is a mixture consisting of 50 mol% of silver behenate and 50 mol% of behenic acid. Therefore, X mol% organic silver salt used in the examples means a mixture consisting of X mol% of organic silver salt and (100-X) mol% of organic acid, and "X mol%" is shown in the formula:

$$\frac{\text{(Mol number of organic silver salt)}}{\text{(Mol number of organic silver salt)} + \text{(Mol number of organic acid)}} \times 100$$

Then, 100 g. of polyvinyl butyral (10 wt.% ethyl alcohol solution) was added to the mixture and sufficiently mixed until the mixture became uniform. To the polymer dispersion liquid containing an organic silver salt thus prepared, 200 mg. of calcium bromide and 120 mg. of mercury acetate were added and mixed, and further to the mixture, the compounds described in Table-1 were further separately added and mixed in the respective amounts shown in Table-8. The thus prepared polymer dispersion liquids were separately coated to art papers in the same manner as in the Reference Example to form organic silver salt layers.

On the other hand, an over-coating layer-forming solution was prepared in the same manner as in the Reference Example and coated to the foregoing organic silver salt layers to prepare heat-developable photosensitive materials for producing an electrostatic printing master [Samples (2-1)–(2-27)].

The heat-developable photosensitive material for producing an electrostatic printing master, Sample (2-1) shown in Table 8, was subjected to the same exposure and heat development as those in the Reference Example to obtain a negative print image so that an electrostatic printing master was prepared.

The corona discharging of +7 KV was uniformly applied to the foregoing electrostatic printing master, and then the negatively charged toner was developed by the magnetic brush development to obtain a positive toner image. An image-receiving paper was placed on the toner image and the foregoing corona discharging was applied from the image receiving paper side to obtain a visible image thus transferred onto the image receiving paper.

Even when such charging and development transferring were repeated to conduct the transferring 1000 times or more, any deterioration in the surface of the master was not observed, and also it was not observed that the transferred image became bad in the image quality. As the result, it was recognized that the foregoing master was excellent one for the repeat printing.

Since the silver image exhibits the reproducibility with faithful with respect to the original image, it was recognized that a faithful electrostatic latent image was correspondingly formed and the toner image correspondingly became a faithful photographic image.

The maximum reflection density of the image portion (silver image portion) in the foregoing electrostatic printing master having the visible image was measured and found to be 1.8. Further, the potential difference (electrostatic potential contrast) between the image portion (silver image portion) and the non-image portion (non-silver image portion) was measured and found to be 350 V. Furthermore, the fog density in the image-receiving paper having the transferred image was measured and found to be a very small value, 0.11.

The heat-developable photosensitive materials for producing an electrostatic printing master, Samples (2-2)–(2-27) shown in Table-8, were tested with respect to the transferred image and mechanical, electrostatic, repeating durability in the same manner as in the case of Sample (2-1) to obtain similarly good results in all cases.

Further, also as regards Samples (2-2)–(2-27), the maximum reflection density of the image portion in the electrostatic printing master having the visible image, the electrostatic potential contrast and the fog density in the image-receiving paper were measured so that both the maximum reflection density and the electrostatic potential contrast were large and the fog density was small, which was a good result as in the case of Sample (2-1).

TABLE 8

TEST RESULTS FOR ELECTROSTATIC PRINTING MASTERS USING TABLE-1 TONING AGENTS

| Sample | Compound | Amount (g) | Max. reflection density | Fog density* | Electrostatic potential contrast (V) |
|---|---|---|---|---|---|
| 2-1 | 1 | 3.0 | 1.8 | 0.11 | 350 |
| 2-2 | 2 | 2.5 | 1.7 | 0.12 | 340 |
| 2-3 | 3 | 2.5 | 1.6 | 0.12 | 340 |
| 2-4 | 4 | 2.5 | 1.7 | 0.14 | 290 |
| 2-5 | 5 | 2.0 | 1.6 | 0.12 | 340 |
| 2-6 | 6 | 2.0 | 1.7 | 0.11 | 350 |
| 2-7 | 7 | 3.0 | 1.9 | 0.12 | 360 |
| 2-8 | 8 | 2.5 | 1.8 | 0.15 | 350 |
| 2-9 | 9 | 2.5 | 1.6 | 0.18 | 300 |
| 2-10 | 10 | 3.0 | 1.8 | 0.12 | 350 |
| 2-11 | 11 | 3.0 | 1.7 | 0.13 | 370 |
| 2-12 | 12 | 3.0 | 1.9 | 0.16 | 330 |
| 2-13 | 13 | 2.5 | 1.6 | 0.17 | 320 |
| 2-14 | 14 | 2.5 | 1.8 | 0.13 | 360 |
| 2-15 | 15 | 2.5 | 1.5 | 0.12 | 340 |
| 2-16 | 16 | 3.0 | 1.6 | 0.12 | 360 |
| 2-17 | 17 | 3.0 | 1.7 | 0.12 | 340 |
| 2-18 | 18 | 2.0 | 1.4 | 0.14 | 310 |
| 2-19 | 19 | 3.2 | 1.8 | 0.11 | 360 |
| 2-20 | 20 | 3.5 | 1.6 | 0.12 | 340 |
| 2-21 | 21 | 2.0 | 1.9 | 0.15 | 400 |
| 2-22 | 22 | 2.0 | 1.3 | 0.16 | 280 |
| 2-23 | 23 | 3.0 | 1.4 | 0.12 | 300 |
| 2-24 | 24 | 3.0 | 1.8 | 0.13 | 350 |
| 2-25 | 25 | 2.0 | 1.5 | 0.16 | 300 |
| 2-26 | 26 | 2.0 | 1.8 | 0.12 | 360 |
| 2-27 | 27 | 2.0 | 1.7 | 0.13 | 350 |

Note:
*Fog density in the image-receiving paper.

EXAMPLE 2

25 g. of 70 mol% silver behenate, 120 g. of methyl ethyl ketone and 120 g. of toluene were mixed and dispersed for 72 hours or more by the ball milling method.

Then, 100 g. of polyvinyl butyral (10 wt.% ethyl alcohol solution) was added to the mixture and sufficiently mixed until the mixture became uniform. To the polymer dispersion liquid containing an organic silver salt thus prepared, 200 mg. of calcium bromide and 120 mg. of mercury acetate were added, and further 2.5 g. of phthalazinone was added and sufficiently mixed. The thus prepared liquid was coated to an art paper in the same manner as in the Reference Example to form an organic silver salt layer.

Next, 0.3 g. of phthalazinone, 10 g. of cellulose acetate (10 wt.% acetone solution) and 30 g. of acetone were mixed, and the compounds described in Table-2 were separately added to the mixture in the respective amounts shown in Table-9 and sufficiently mixed to prepare over-coating layer-forming solutions. These solutions were separately coated onto the foregoing organic silver salt layer in the same manner as in the Reference Example to prepare heat-developable photosensitive materials for producing an electrostatic printing master [Samples (3-1)–(3-27)].

Samples (3-1)–(3-27) shown in Table-9 were subjected to the same procedure as in Example 1 to obtain transferred visible images on the image-receiving papers. The visible images were all very clear and small in the fog density. With respect to Samples (3-1)–(3-27), the maximum reflection density, electrostatic potential contrast and fog density on the transferring paper were measured in the same manner as in Example 1 to obtain good results shown in Table-9 as in the case of Example 1.

TABLE 9

RESULTS FOR ELECTROSTATIC PRINTING MASTERS USING TABLE-2 REDUCING AGENTS

| Sample | Compound | Amount (g) | Max. reflection density | Fog density* | Electrostatic potential contrast (V) |
|---|---|---|---|---|---|
| 3-1 | 28 | 1.5 | 1.7 | 0.12 | 380 |
| 3-2 | 29 | 1.5 | 1.6 | 0.12 | 400 |
| 3-3 | 30 | 1.5 | 1.8 | 0.14 | 400 |
| 3-4 | 31 | 1.0 | 1.7 | 0.16 | 380 |
| 3-5 | 32 | 1.0 | 1.6 | 0.15 | 350 |
| 3-6 | 33 | 1.5 | 1.5 | 0.12 | 340 |
| 3-7 | 34 | 2.0 | 1.4 | 0.13 | 360 |
| 3-8 | 35 | 2.0 | 1.6 | 0.16 | 390 |
| 3-9 | 36 | 1.5 | 1.3 | 0.13 | 350 |
| 3-10 | 37 | 2.0 | 1.8 | 0.16 | 400 |
| 3-11 | 38 | 2.0 | 1.7 | 0.13 | 380 |
| 3-12 | 39 | 2.0 | 1.5 | 0.12 | 380 |
| 3-13 | 40 | 2.0 | 1.8 | 0.12 | 350 |
| 3-14 | 41 | 2.0 | 1.9 | 0.14 | 370 |
| 3-15 | 42 | 2.0 | 1.8 | 0.15 | 400 |
| 3-16 | 43 | 2.0 | 1.5 | 0.14 | 360 |
| 3-17 | 44 | 1.5 | 1.4 | 0.12 | 360 |
| 3-18 | 45 | 1.5 | 1.8 | 0.12 | 410 |
| 3-19 | 46 | 1.5 | 1.3 | 0.13 | 340 |
| 3-20 | 47 | 1.5 | 1.6 | 0.16 | 340 |
| 3-21 | 48 | 1.5 | 1.9 | 0.13 | 420 |
| 3-22 | 49 | 1.5 | 1.7 | 0.16 | 380 |
| 3-23 | 50 | 1.5 | 1.5 | 0.13 | 360 |
| 3-24 | 51 | 1.0 | 1.6 | 0.12 | 370 |
| 3-25 | 52 | 1.0 | 1.8 | 0.14 | 400 |
| 3-26 | 53 | 1.0 | 1.8 | 0.13 | 410 |
| 3-27 | 54 | 1.5 | 1.6 | 0.13 | 380 |

Note:
*Fog density on the image-receiving paper.

EXAMPLE 3

25 g. of 90 mol% silver behenate, 120 g.of methyl ethyl ketone and 120 g. of toluene were mixed and dispersed for 72 hours or more by the ball milling method.

Then, 100 g. of polyvinyl butyral (20 wt.% ethyl alcohol solution) was added to the mixture and sufficiently mixed until the mixture became uniform. To the polymer dispersion liquid thus prepared, the halides described in Table-3 were separately added in the respective amounts shown in Table-10, and further 120 mg. of mercury acetate and 2.5 g. of phthalazinone were added to the mixtures and mixed. The polymer dispersion liquids thus prepared were separately coated onto art papers in the same manner as in Example 1 to form organic silver salt layers.

On the other hand, 1.5 g. of 2,2'-methylene-bis-(6-t-butyl-p-cresol), 0.3 g. of phthalazinone, 10 g. of cellulose acetate (10 wt.% acetone solution) and 30 g. of acetone were mixed to prepare an over-coating layer-forming solution. This solution was coated to the foregoing organic silver salt layers to prepare heat-developable photosensitive materials for producing an electrostatic printing master [Samples (4-1)–(4-8)].

Samples (4-1)–(4-8) shown in Table-10 were subjected to the same procedure as in Example 1 to obtain transferred visible images on the image-receiving papers. The visible images were all very clear and small in the fog density. With respect to Samples (4-1)–(4-8), the maximum reflection density, electrostatic potential contrast and fog density on the image-receiving paper were measured in the same manner as in Example 1 to obtain good results shown in Table-10 as in the case of Example 1.

TABLE 10

TEST RESULTS FOR ELECTROSTATIC PRINTING MASTERS USING TABLE-3 HALIDES

| Sample | Compound | Amount (mg) | Max. reflection density | Fog density* | Electrostatic potential contrast (V) |
|---|---|---|---|---|---|
| 4-1 | 55 | 250 | 1.5 | 0.14 | 420 |
| 4-2 | 56 | 250 | 1.9 | 0.12 | 400 |
| 4-3 | 57 | 300 | 1.8 | 0.11 | 400 |
| 4-4 | 58 | 350 | 1.8 | 0.12 | 410 |
| 4-5 | 59 | 300 | 1.7 | 0.12 | 380 |
| 4-6 | 60 | 200 | 1.6 | 0.13 | 400 |
| 4-7 | 61 | 200 | 1.6 | 0.14 | 390 |
| 4-8 | 62 | 200 | 1.5 | 0.15 | 360 |

Note:
*Fog density on the image-receiving paper.

EXAMPLE 4

The following organic silver salt layer-forming composition A-1 and over-coating layer-forming composition B-1 were prepared and coated onto an art paper in accordance with the procedure of the Reference Example to prepare heat-developable photosensitive materials for producing an electrostatic printing master [Samples (5-1)–(5-35)].

| Composition A-1: | |
|---|---|
| 90 mol % silver behenate | 25 g. |
| MEK | 120 g. |
| Toluene | 120 g. |
| Polyvinyl butyral (20 wt. % EtOH) | 100 g. |
| Solution of 120 mg. of mercury acetate in 25 ml. of MeOH | |

-continued

| | |
|---|---|
| Solution of 200 mg. of $CaBr_2$ in 25 ml. of MeOH | |
| Phthalazinone | 2.5 g. |
| One of the compounds in Table-4 | |
| Composition B-1: | |
| 2,2'-methylene-bis-(6-t-butyl-p-cresol) | 1.5 g. |
| Cellulose acetate (10 wt. % acetone) | 10 g. |
| Acetone | 30 g. |

Samples (5-1)–(5-35) shown in Table-11 were subjected to the same treatment as that in Example 1 to obtain transferred visible images on the image-receiving papers. The visible images were very clear and the fog density was small in each case. With respect to Samples (5-1)–(5-35), the maximum reflection density, the electrostatic potential contrast and the fog density in the image-receiving paper were measured in the same manner as in Example 1 to obtain good results shown in Table-11 as in the case of Example 1. Particularly, decrease in the fog density was remarkable.

TABLE 11

TEST RESULTS FOR ELECTROSTATIC PRINTING MASTERS USING TABLE-4 STABILIZERS AND LIGHT RESISTANCE AGENTS

| Sample | Compound | Amount (mg) | Max. reflection density | Fog density* | Electrostatic potential contrast (V) |
|---|---|---|---|---|---|
| 5-1 | 63 | 40 | 1.8 | 0.11 | 450 |
| 5-2 | 64 | 50 | 1.8 | 0.14 | 440 |
| 5-5 | 65 | 80 | 1.8 | 0.12 | 440 |
| 5-4 | 66 | 50 | 1.9 | 0.12 | 460 |
| 5-5 | 67 | 50 | 1.9 | 0.11 | 480 |
| 5-6 | 68 | 40 | 1.6 | 0.13 | 420 |
| 5-7 | 69 | 40 | 1.6 | 0.13 | 430 |
| 5-8 | 70 | 50 | 1.8 | 0.11 | 450 |
| 5-9 | 71 | 50 | 1.7 | 0.12 | 400 |
| 5-10 | 72 | 50 | 1.7 | 0.12 | 410 |
| 5-11 | 73 | 40 | 1.6 | 0.11 | 400 |
| 5-12 | 74 | 40 | 1.5 | 0.11 | 400 |
| 5-13 | 75 | 50 | 1.6 | 0.12 | 420 |
| 5-14 | 76 | 50 | 1.6 | 0.11 | 420 |
| 5-15 | 77 | 80 | 1.4 | 0.12 | 400 |
| 5-16 | 78 | 80 | 1.8 | 0.13 | 450 |
| 5-17 | 79 | 50 | 1.6 | 0.13 | 430 |
| 5-18 | 80 | 50 | 1.6 | 0.12 | 430 |
| 5-19 | 81 | 50 | 1.8 | 0.12 | 460 |
| 5-20 | 82 | 50 | 1.8 | 0.12 | 460 |
| 5-21 | 83 | 80 | 1.9 | 0.11 | 480 |
| 5-22 | 84 | 40 | 1.6 | 0.11 | 460 |
| 5-23 | 85 | 40 | 1.7 | 0.11 | 460 |
| 5-24 | 86 | 40 | 1.7 | 0.12 | 460 |
| 5-25 | 87 | 50 | 1.8 | 0.13 | 450 |
| 5-26 | 88 | 40 | 1.4 | 0.11 | 430 |
| 5-27 | 89 | 40 | 1.4 | 0.11 | 430 |
| 5-28 | 90 | 50 | 1.6 | 0.11 | 450 |
| 5-29 | 91 | 50 | 1.6 | 0.12 | 440 |
| 5-30 | 92 | 50 | 1.8 | 0.12 | 460 |
| 5-31 | 93 | 50 | 1.8 | 0.11 | 480 |
| 5-32 | 94 | 80 | 1.8 | 0.11 | 480 |
| 5-33 | 95 | 80 | 1.6 | 0.11 | 450 |
| 5-34 | 96 | 50 | 1.6 | 0.12 | 450 |
| 5-35 | 97 | 50 | 1.6 | 0.11 | 450 |

Note:
*Fog density on the image-receiving paper.

EXAMPLE 5

25 g. of 90 mol% silver behenate, 120 g. of methyl ethyl ketone and 120 g. of toluene were mixed and dispersed for 72 hours or more by the ball milling method.

Then, 100 g. of polyvinyl butyral (10 wt.% ethyl alcohol solution) was added to the mixture and sufficiently mixed until the mixture became uniform. To the polymer dispersion liquid containing an organic silver salt thus prepared, 200 mg. of calcium bromide, 120 mg. of mercury acetate and 2.5 g. of phthalazinone were added and mixed. The thus prepared polymer dispersion liquid was coated to an art paper in the same manner as in the Reference Example to form an organic silver salt layer.

Next, 1.5 g. of 2,2'-methylene-bis-(6-t-butyl-p-cresol), 0.3 g. of phthalazinone, 10 g. of cellulose acetate (10 wt.% of acetone solution) and 30 g. of acetone were mixed, and the compounds described in Table-5 were separately added to the mixture in the respective amounts shown in Table-12 and sufficiently mixed to prepare over-coating layer-forming solutions. These solutions were separately coated onto the foregoing organic silver salt layer in the same manner as in the Reference Example to prepare heat-developable photosensitive materials for producing an electrostatic printing master [Samples (6-1)–(6-39)].

Samples (6-1)–(6-39) shown in Table-12 were subjected to the same procedure as in Example 1 to obtain transferred visible images on the image-receiving papers. The visible images were all very clear and small in the fog density. With respect to Samples (6-1)–(6-39), the maximum reflection density, electrostatic potential contrast and fog density on the image-receiving paper were measured in the same manner as in Example 1 to obtain good results shown in Table-12 as in the case of Example 1. Particularly, the maximum reflection density was remarkably large.

TABLE 12

TEST RESULTS FOR ELECTROSTATIC PRINTING MASTERS USING TABLE-5 DYE SENSITIZERS

| Sample | Compound | Amount (mg) | Max. reflection density | Fog density* | Electrostatic potential contrast (V) |
|---|---|---|---|---|---|
| 6-1 | 98 | 5 | 1.8 | 0.13 | 450 |
| 6-2 | 99 | 5 | 1.8 | 0.14 | 450 |
| 6-3 | 100 | 5 | 1.8 | 0.12 | 450 |
| 6-4 | 101 | 5 | 1.8 | 0.12 | 450 |
| 6-5 | 102 | 5 | 1.9 | 0.13 | 480 |
| 6-6 | 103 | 3 | 1.9 | 0.13 | 480 |
| 6-7 | 104 | 3 | 1.7 | 0.13 | 430 |
| 6-8 | 105 | 5 | 1.6 | 0.14 | 430 |
| 6-9 | 106 | 5 | 1.8 | 0.13 | 460 |
| 6-10 | 107 | 5 | 1.8 | 0.14 | 450 |
| 6-11 | 108 | 5 | 1.7 | 0.14 | 430 |
| 6-12 | 109 | 5 | 1.8 | 0.14 | 450 |
| 6-13 | 110 | 5 | 1.8 | 0.13 | 450 |
| 6-14 | 111 | 5 | 1.9 | 0.12 | 480 |
| 6-15 | 112 | 5 | 1.8 | 0.12 | 460 |
| 6-16 | 113 | 6 | 1.8 | 0.12 | 460 |
| 6-17 | 114 | 6 | 2.0 | 0.13 | 500 |
| 6-18 | 115 | 6 | 1.6 | 0.14 | 430 |
| 6-19 | 116 | 6 | 1.8 | 0.13 | 450 |
| 6-20 | 117 | 6 | 1.8 | 0.13 | 460 |
| 6-21 | 118 | 6 | 1.9 | 0.12 | 490 |
| 6-22 | 119 | 6 | 1.9 | 0.13 | 480 |
| 6-23 | 120 | 6 | 1.6 | 0.14 | 440 |
| 6-24 | 121 | 5 | 1.7 | 0.12 | 450 |
| 6-25 | 122 | 5 | 1.7 | 0.12 | 450 |
| 6-26 | 123 | 5 | 1.8 | 0.12 | 450 |
| 6-27 | 124 | 5 | 1.8 | 0.13 | 450 |
| 6-28 | 125 | 6 | 1.6 | 0.13 | 440 |
| 6-29 | 126 | 6 | 1.6 | 0.13 | 440 |
| 6-30 | 127 | 6 | 1.7 | 0.13 | 440 |
| 6-31 | 128 | 6 | 1.9 | 0.13 | 480 |
| 6-32 | 129 | 5 | 1.8 | 0.14 | 450 |
| 6-33 | 130 | 6 | 1.8 | 0.14 | 450 |
| 6-34 | 131 | 6 | 1.8 | 0.12 | 450 |
| 6-35 | 132 | 6 | 1.9 | 0.12 | 480 |
| 6-36 | 133 | 6 | 1.7 | 0.12 | 450 |
| 6-37 | 134 | 6 | 1.7 | 0.13 | 450 |
| 6-38 | 135 | 6 | 1.6 | 0.13 | 430 |

TABLE 12-continued

TEST RESULTS FOR ELECTROSTATIC PRINTING MASTERS USING TABLE-5 DYE SENSITIZERS

| Sample | Compound | Amount (mg) | Max. reflection density | Fog density* | Electrostatic potential contrast (V) |
|---|---|---|---|---|---|
| 6-39 | 136 | 6 | 1.6 | 0.12 | 430 |

Note:
*Fog density on the image-receiving paper.

EXAMPLE 6

An organic silver salt layer and an over-coating layer were both formed on an art paper in accordance with the Reference Example. The polymer solutions shown in Table-6 were separately coated as the third layer onto the over-coating layer at a dark place in the thickness of about 5μ after drying to prepare heat-developable photosensitive materials for producing an electrostatic printing master [Samples (7-1)–(7-9)].

Samples (7-1)–(7-9) shown in Table-13 were subjected to the same procedure as in Example 1 to obtain transferred visible images on the image-receiving papers. The visible images were all very clear and small in the fog density. These samples were found to be very excellent in the mechanical, electrostatic, repeating durability. With respect to Samples (7-1)–(7-9), the maximum reflection density, electrostatic potential contrast and fog density on the image-receiving paper were measured in the same manner as in Example 1 to obtain good results shown in Table-13 as in the case of Example 1.

TABLE 13

TEST RESULTS FOR ELECTROSTATIC PRINTING MASTERS USING TABLE-6 MATERIALS FOR FORMING SURFACE PROTECTING LAYER

| Sample | Polymer solution | Max. reflection density | Fog density | Electrostatic potential contrast (V) |
|---|---|---|---|---|
| 7-1 | 137 | 1.9 | 0.12 | 450 |
| 7-2 | 138 | 2.0 | 0.13 | 460 |
| 7-3 | 139 | 1.8 | 0.13 | 450 |
| 7-4 | 140 | 1.8 | 0.12 | 450 |
| 7-5 | 141 | 2.0 | 0.12 | 480 |
| 7-6 | 142 | 1.6 | 0.13 | 450 |
| 7-7 | 143 | 1.5 | 0.14 | 430 |
| 7-8 | 144 | 1.4 | 0.13 | 430 |
| 7-9 | 145 | 1.6 | 0.13 | 450 |

EXAMPLE 7

The following organic silver salt layer-forming composition A-2 and over-coating layer-forming composition B-2 were prepared in accordance with the procedure of Example 1. Next, the electroconductivity imparting solutions shown in Table-7 were separately coated onto art papers by a coating rod in the thickness of about 2μ after drying to form electroconductive layers. Compositions A-2 and B-2 were coated onto the opposite side to the electroconductive layer on the art paper, in other words, onto the art-untreated surface side in accordance with the Reference Example to prepare heat-developable photosensitive materials for producing an electrostatic printing master [Samples (8-1)–(8-7)].

| Composition A-2: | |
|---|---|
| 90 mol % silver behenate | 25 g. |
| MEK | 120 g. |
| Toluene | 120 g. |
| Polyvinyl butyral (20 wt. % EtOH) | 100 g. |
| Solution of 120 mg. of mercury acetate in 25 ml. of MeOH | |
| Solution of 200 mg. of $CaBr_2$ in 25 ml. of MeOH | |
| Phthalazinone | 2.5 g. |
| **Composition B-2:** | |
| 2,2'-methylene-bis-(6-t-butyl-p-cresol) | 1.0 g. |
| Cellulose acetate (10 wt. % acetone) | 10 g. |
| Acetone | 30 g. |

Samples (8-1)–(8-7) shown in Table-14 were subjected to the same procedure as in Example 1 to obtain transferred visible images on the image-receiving papers. The visible images were all very clear and small in the fog density. With respect to Samples (8-1)–(8-7), the maximum reflection density, electrostatic potential contrast and fog density on the image-receiving paper were measured in the same manner as in Example 1 to obtain good results shown in Table-14 as in the case of Example 1.

TABLE 14

TEST RESULTS FOR ELECTROSTATIC PRINTING MASTERS USING TABLE-7 CONDUCTIVE LAYER FORMING MATERIAL

| Sample | Electro-conductivity imparting solution | Max. reflection density | Fog density* | Electrostatic potential contrast (V) |
|---|---|---|---|---|
| 8-1 | 146 | 1.8 | 0.11 | 450 |
| 8-2 | 147 | 1.6 | 0.12 | 430 |
| 8-3 | 148 | 1.7 | 0.11 | 450 |
| 8-4 | 149 | 1.7 | 0.14 | 420 |
| 8-5 | 150 | 1.6 | 0.13 | 430 |
| 8-6 | 151 | 1.6 | 0.13 | 430 |
| 8-7 | 152 | 1.8 | 0.12 | 450 |

EXAMPLE 8

Electroconductivity imparting solutions 146–152 shown in Table-7 were separately coated onto art papers in the same manner as in Example 7 to form electroconductive layers. The same compositions A-2 and B-2 as those in Example 7 were coated to the surfaces of the electroconductive layers on the art papers in accordance with procedure as in the Reference Example to prepare heat-developable photosensitive materials for producing an electrostatic printing master.

These heat-developable photosensitive materials were subjected to the same treatment as in Example 1 to obtain the transferred visible images on the image-receiving papers. As the result, it was found that the photosensitive materials were very excellent in the image quality, the mechanical, electrostatic repeating durability and the practicality.

EXAMPLE 9

10 g. of silver laurate, 30 g. of toluene and 120 g. of methyl ethyl ketone were mixed and dispersed for 72 hours or more by the ball milling method.

Then, 60 g. of polyvinyl butyral (10 wt.% ethyl alcohol solution) was added to the mixture and sufficiently mixed. To the polymer dispersion liquid containing an organic silver salt thus prepared, 50 mg. of mercury acetate, 60 mg. of $CaBr_2$ and 0.5 g. of compound (10) were added and mixed. This polymer dispersion liquid was coated onto an art paper at a dark place by a coating rod in the thickness of 8μ after drying to form an organic silver salt layer.

On the other hand, 1.0 g. of compound (45), 3 mg. of compound (130), 10 g. of cellulose acetate (10 wt.% acetone solution) and 25 g. of acetone were mixed to prepare an overcoating layer-forming solution. This solution was coated onto the foregoing organic silver salt layer at a dark place in the thickness of 4μ after drying to prepare a heat-developable photosensitive material for producing an electrostatic printing master.

The foregoing photosensitive material was exposed to a tungsten light source (2500 lux) through a positive image for 15 seconds, and then heat development was conducted at 120° C. for 2 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the transferring paper were measured in the same manner as in Example 1 to obtain a good result as shown in Table-15.

EXAMPLE 10

The following organic silver salt layer-forming composition A-3 and over-coating layer-forming composition B-3 were prepared in accordance with the procedure of Example 9 and coated onto an art paper to prepare a heat-developable photosensitive material for producing an electrostatic printing master.

| | |
|---|---|
| Composition A-3: | |
| Silver stearate | 10 g. |
| MEK | 30 g. |
| Toluene | 30 g. |
| Polyvinyl butyral (10 wt. % ethyl alcohol solution) | 60 g. |
| $CaI_2$ | 60 mg. |
| Compound (74) | 50 mg. |
| Compound (1) | 1.0 g. |
| Composition B-3: | |
| 2,2'-methylene-bis-(6-t-butyl-p-cresol) | 1.0 g. |
| Phthalazinone | 0.3 g. |
| Cellulose acetate (10 wt. % acetone) | 10 g. |
| Acetone | 30 g. |

The foregoing photosensitive material was exposed to a tungsten light source (2500 lux) through a positive image for 20 seconds, and then heat development was conducted at 120° C. for 5 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the image-receiving paper were measured in the same manner as in Example 1 to obtain a good result as shown in Table-15.

EXAMPLE 11

The following organic silver salt layer-forming composition A-4 and over-coating layer-forming composition B-4 were prepared in accordance with the procedure of Example 9 and coated onto an art paper to prepare a heat-developable photosensitive material for producing an electrostatic printing master.

| | |
|---|---|
| Compositions A-4: | |
| Silver caprate | 10 g. |
| MEK | 30 g. |
| Toluene | 30 g. |
| Polyvinyl butyral (10 wt. % ethyl alcohol solution) | 60 g. |
| $CaBr_2$ | 60 mg. |
| Compound (94) | 50 mg. |
| Compound (6) | 1 g. |
| Mercury acetate | 50 mg. |
| Composition B-4: | |
| 2,2'-methylene-bis-(6-t-butyl-p-cresol) | 1.0 g. |
| Cellulose acetate (10 wt. % acetone) | 10 g. |
| Acetone | 30 g. |
| Coupound (118) | 3 mg. |

The foregoing photosensitive material was exposed to a tungsten light source (2500 lux) through a positive image for 15 seconds, and then heat development was conducted at 120° C. for 3 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the image-receiving paper were measured in the same manner as in Example 1 to obtain a good result as shown in Table-15.

EXAMPLE 12

The following organic silver salt layer-forming composition A-5 and over-coating layer-forming composition B-5 were prepared in accordance with the procedure of Example 9 and coated onto an art paper to prepare a heat-developable photosensitive material for producing an electrostatic printing master.

| | |
|---|---|
| Composition A-5: | |
| 90 mol % silver behenate | 25 g. |
| MEK | 120 g. |
| Toluene | 120 g. |
| Polyvinyl butyral (10 wt. % ethyl alcohol solution) | 100 g. |
| $CaBr_2$ | 200 mg. |
| Mercury acetate | 120 mg. |
| Compound (16) | 2.0 g. |
| Composition B-5: | |
| Compound (28) | 1.5 g. |
| Compound (128) | 3 mg. |
| Cellulose acetate (10 wt. % acetone solution) | 10 g. |
| Acetone | 30 g. |

The foregoing photosensitive material was exposed to a tungsten light source (2500 lux) through a positive image for 15 seconds, and then heat development was conducted at 120° C. for 2 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the image-receiving paper were measured in the same manner as in Example 1 to obtain a good result as shown in Table-15.

EXAMPLE 13

The following organic silver salt layer-forming composition A-6 and over-coating layer-forming composition B-6 were prepared in accordance with the procedure of Example 9 and coated onto an art paper to prepare a heat-developable photosensitive material for producing an electrostatic printing master.

| | |
|---|---|
| Composition A-6: | |
| 90 mol % silver behenate | 25 g. |
| MEK | 120 g. |
| Toluene | 120 g. |
| Polyvinyl butyral (10 wt. % ethyl alcohol solution) | 100 g. |
| Mercury acetate | 120 mg. |
| $SrBr_2$ | 200 mg. |
| Compound (89) | 20 mg. |
| Compound (80) | 20 mg. |
| Compound (70) | 50 mg. |
| Compound (4) | 2.5 g. |
| Composition B-6: | |
| Compound (29) | 1.5 g. |
| Compound (4) | 0.3 g. |
| Compound (102) | 5 mg. |
| Cellulose acetate (10 wt. % acetone solution) | 10 g. |
| Acetone | 30 g. |

The foregoing photosensitive material was exposed to a tungsten light source (2500 lux) through a positive image for 15 seconds, and then heat development was conducted at 120° C. for 2 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the image-receiving paper were measured in the same manner as in Example 1 to obtain a good result as shown in Table-15.

EXAMPLE 14

25 g. of 90 mol% silver behenate, 120 g. of methyl ethyl ketone and 120 g. of toluene were mixed and dispersed for 72 hours or more by the ball milling method.

Then, 100 g. of polyvinyl butyral (20 wt.% ethyl alcohol solution) was added to the mixture and sufficiently mixed until the mixture became uniform. To the polymer dispersion liquid containing an organic silver salt thus prepared, 200 mg. of calcium bromide, 3 g. of phthalic acid, 2 g. of imidazole and 150 mg. of mercury acetate were added and mixed. Then, 6 g. of 2,2'-methylene-bis-(6-t-butyl-p-cresol) was added, and further 2 ml. of a 5 wt.% acetone solution of compound (135) was added and sufficiently mixed. The thus prepared polymer dispersion liquid was coated onto the art surface side of the art upper on which an electroconductive layer was formed by electroconductivity imparting solution (147) in the manner of Example 7, by using a coating rod in the thickness of 8μ after drying to prepare a heat-developable photosensitive material for producing an electrostatic printing master.

The foregoing photosensitive material was exposed to a tungsten light source (2500 lux) through a positive image for 15 seconds, and then heat development was conducted at 120° C. for 2 seconds to obtain a negative print visible image so that an electrostatic printing master was prepared.

Next, the same corona charging-toner development-transferring step as in Example 1 was carried out with respect to the above-mentioned master so that a good transferred visible image could be obtained on the image-receiving paper.

With respect to the sample of this example, the maximum reflection density, electrostatic potential contrast and fog density on the image-receiving paper were measured in the same manner as in Example 1 to obtain a good result as shown in Table-15.

EXAMPLE 15

25 g. of 70 mol% silver behenate, 120 g. of toluene and 120 g. of methyl ethyl ketone were mixed and dispersed for 72 hours or more by the ball milling method. Then, 100 g. of polyvinyl butyral (10 wt.% ethyl alcohol solution) was added to the mixture and sufficiently mixed. To the polymer dispersion liquid containing an organic silver salt thus prepared, 150 mg. of ammonium bromide, 100 mg. of mercury acetate and 3.0 g. of compound (12) were added and mixed. The polymer dispersion liquid was coated onto an art paper in accordance with the procedure of Example 9 to form an organic silver salt layer.

On the other hand, 1 g. of compound (44), 0.5 g. of compound (45), 10 g. of cellulose acetate (10 wt.% acetone solution), 40 g. of acetone and 5 mg. of compound having the formula:

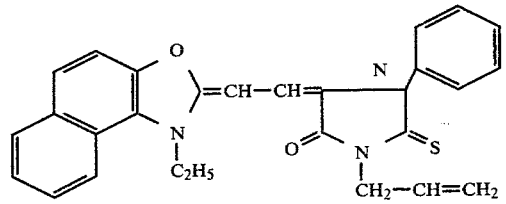

were added to prepare an over-coating layer-forming solution. This solution was coated onto the foregoing organic silver salt layer in accordance with the procedure of Example 9. Further, onto the over-coating layer, polymer solution (141) was coated in the thickness of about 3μ after drying to prepare a heat-developable photosensitive material for producing an electrostatic printing master.

The foregoing photosensitive material was exposed to a tungsten light source (2500 lux) through a positive image for 15 seconds, and then heat development was conducted at 120° C. for 2 seconds to obtain a negative print visible image so that an electrostatic printing master was prepared.

Next, the electrostatic printing master was subjected to the same corona charging-toner development-transferring step as in Example 1 so that a good transferred visible image could be obtained on the image-receiving paper.

Further, with respect to the sample of this example, the maximum reflection density, electrostatic potential contrast and fog density on the image-receiving paper were measured in the same manner as in Example 1 to obtain a very good result as shown in Table-15.

TABLE 15

TEST RESULTS FOR EXAMPLES 9-15

| Example | Max. reflection density | Fog density | Electrostatic potential contrast (V) |
|---|---|---|---|
| 9 | 1.0 | 0.15 | 250 |
| 10 | 1.2 | 0.15 | 280 |
| 11 | 1.0 | 0.16 | 250 |
| 12 | 1.6 | 0.14 | 450 |
| 13 | 1.8 | 0.13 | 460 |
| 14 | 1.9 | 0.13 | 480 |
| 15 | 2.0 | 0.12 | 400 |

EXAMPLE 16

25 g. of behenic acid, 120 g. of toluene were uniformly stirred and dispersed by using an atriter. To the dispersion, 200 g. of 20% ethanol solution of polyvinyl butyral resin was added. 120 mg. of mercury acetate, 2.5 g. of phthalimide and 200 mg. of calcium bromide were further added and uniformly mixed.

The above-mentioned dispersion liquid was uniformly coated onto an india paper (MS India, trade name, supplied by Mishima Seishi K.K., A size 15.7 kg) by using a coating rod (#16) and dried at 70° C. for 10 minutes.

Further, a mixture of 2 g. of 2,6-di-t-butyl-p-cresol, 0.2 g. of phthalazinone, 20 g. of 10% acetone solution of cellulose acetate and 20 g. of acetone was coated by using a coating rod (#8) and dried at a dark place at 80° C. for 3 minutes.

The photosensitive material thus prepared was semi-transparent. The film side formed on the photosensitive material was brought into contact with the surface of a test chart (for reflection) standardized by the Society of Electrophotography of Japan. And, the back side of the photosensitive material was exposed to a 300 W tungsten lamp positioned at a distance of 30 cm over the back side for 15 seconds. The exposed photosensitive material was heated at 130° C. for 2 seconds by a roller type heat developing device to obtain a visible image, which was a negative and reversed image with respect to the original test chart, so that an electrostatic printing master was prepared.

Corona discharge of +7 KV was applied uniformly to the foregoing master, and the negatively charged toner was given to the master by the magnetic brush development, and further the transferring was conducted while the corona charging was applied from the image-receiving paper side so that a visible toner image was obtained on the image-receiving paper. The toner image thus transferred was fixed by means of a heater at 130° C. This image was a positive one with respect to the original test chart. Even when the charging and development transferring steps were repeated to conduct the transferring 2000 times or more, any deterioration in the master surface was not observed and the quality of the transferred image did not become bad. It was recognized that the master was excellent one for the repeat printing.

Since the silver image exhibits the reproducibility with faithful about the original, the faithful electrostatic latent image was correspondingly formed and the toner image also became correspondingly a faithful photographic image.

EXAMPLE 17

25 g. of equivalent mole mixture of silver behenate and behenic acid, 120 g. of toluene and 120 g. of acetone were mixed and pulverized for 90 hours by a ball mill to prepare a uniform slurry. 100 g. of an ethanol solution (10 wt.%) of polyvinyl butyral resin was added to the slurry and mixed. Further, 0.2 g. of calcium bromide, 2.5 g. of phthalozinone and 0.12 g. of mercury acetate were added.

The dispersion liquid thus prepared was uniformly coated onto an india paper (trade name: Corona S A size 32 kg, supplied by Honshu Seishi K.K.) by using a coating rod (#24) and dried at 80° C. for 5 minutes.

Onto the thus formed silver behenate-containing layer, the mixed liquid of the following composition was coated by using a coating rod (#16) and dried at a dark place at 80° C. for 4 minutes.

| | |
|---|---|
| 2,6-dichloro-4-benzene-sulfonamidophenol | 1.2 g. |
| N-hydroxyphthalimide | 0.4 g. |
| Polyvinyl butyral resin (10% propyl alcohol sol.) | 10 g. |
| Ethanol | 20 g. |

The photosensitive material thus prepared was semi-transparent. With respect to the photosensitive material, the exposure was conducted by the reflex contact process in the same manner as in Example 16 and then heat development was effected to prepare an electrostatic printing master.

Also in this example, a good result was obtained as in the case of Example 16 and the sample was a master excellent in the mechanical, electrostatic, repeating durability.

EXAMPLE 18

The same procedure as that in Example 16 was repeated except that silver laurate was used in place of silver behenate and the support was replaced by a wood free paper (an image-receiving paper for a copier Canon NP-1100, trade name, supplied by Canon K.K.) onto which aluminum was vacuum deposited in the thickness of 50–100 Å.

The heat-developable photosensitive material of this example was subjected to the exposure and heat development in the same manner as in Example 16.

As a sample for comparison, there was used a photosensitive material which was prepared in the same manner as above except that the support was replaced by a wood free paper onto which aluminum was not vacuum deposited.

In the heat-developable photosensitive material using the aluminum-deposited paper, the multiple reflection of the exposed light occurred at the portion corresponding to the non-image portion of the original so that the apparent photosensitivity became about 1.7 times.

Further, such material using the aluminum-deposited paper was subjected to the corona charging of 6 KV for 5 seconds and the surface potential was measured. As the result, it was found that the surface potential of the silver image portion was 270 V and that of the non-silver image portion was 540 V.

EXAMPLE 19

20 g. of silver behenate, 10 g. of copper stearate, 120 g. of methyl ethyl ketone and 120 g. of toluene were mixed and pulverized by a ball mill for 72 hours, and then 50 g. of ethanol and 100 g. of a 20% ethanol solution of polyvinyl butyral were added. The thus prepared dispersion liquid was coated onto the opposite side to the electroconductivity-imparted surface of the art paper (trade name: OLIGO-ZM-1010, supplied by Tomoegawa Seishijo K.K. ) by a coating rod (#32) and dried at 60° C. for 5 minutes.

Next, the following mixture was further coated at 50° C. by a coating rod (#18) and dried for two minutes.

| | |
|---|---|
| 2,2'-methylene-bis-6-t-butyl-p-cresol | 1.5 g. |
| Phthalazinone | 0.3 g. |
| Cellulose acetate (10% acetone solution) | 10 g. |
| Acetone | 30 g. |

The thus prepared photosensitive material was subjected to the pre-heat treatment at 115° C. for two seconds and the exposure and heat development were conducted in the same manner as in Example 16 to obtain a black image. This photosensitive material was used as an electrostatic printing master and the charging-toner development-transferring step was conducted to obtain a clear and sharp transferred image.

EXAMPLE 20

Onto each over-coating layer of Samples (2-1)–(2-27) in Table-8, Samples (3-1)–(3027) in Table-9, Samples (4-1)–(4-8) in Table-10, Samples (5-1)–(5-35) in Table-11 and Samples (6-1)–(6-39) in Table-12, each of the polymer solutions (138), (140) and (141) was coated in accordance with the procedure of Example 6 to prepare a heat-developable photosensitive material for producing an electrostatic printing master.

It was tested in the same manner as in Example 1 whether or not each photosensitive material was suitable for a repeat printing master. As the result, it was found that each heat-developable photosensitive material for producing an electrostatic printing master was excellent in the cleaning property, the quality of the visible image obtained on the image-receiving paper and the mechanical, electrostatic, repeating durability as shown in Tables 16–29.

Note: In Table-16 to Table-29, "image quality" stands for the quality of the visible image obtained on the image-receiving paper, and "durability" stands for mechanical, electrostatic, repeating durability. Further ◎ shows very good, ○ good and Δ somewhat good.

TABLE 16

| Sample | Used polymer solution: (138) Cleaning property | Image quality | Durability |
|---|---|---|---|
| 2-1 | ◎ | ○ | ◎ |
| 2-2 | ◎ | ○ | ○ |
| 2-3 | ○ | ○ | ○ |
| 2-4 | ○ | ○ | ○ |
| 2-5 | ○ | ○ | ○ |
| 2-6 | ◎ | ◎ | ○ |
| 2-7 | ◎ | ◎ | ◎ |
| 2-8 | ○ | ○ | ○ |
| 2-9 | ○ | ○ | ○ |
| 2-10 | ◎ | ○ | ○ |
| 2-11 | ○ | ○ | ◎ |
| 2-12 | ○ | ○ | ○ |

TABLE 16-continued

| Sample | Used polymer solution: (138) Cleaning property | Image quality | Durability |
|---|---|---|---|
| 2-13 | ○ | ○ | ○ |
| 2-14 | ◎ | ○ | ○ |
| 2-15 | ○ | Δ | ○ |
| 2-16 | ○ | ○ | ◎ |
| 2-17 | ○ | ○ | ◎ |
| 2-18 | ○ | ○ | ○ |
| 2-19 | ◎ | ○ | Δ |
| 2-20 | ○ | ○ | ○ |
| 2-21 | ◎ | ○ | ◎ |
| 2-22 | ○ | ○ | ○ |
| 2-23 | ○ | ○ | ○ |
| 2-24 | ○ | ○ | ○ |
| 2-25 | ○ | ○ | ○ |
| 2-26 | ○ | ○ | ○ |
| 2-27 | ◎ | ○ | ◎ |

TABLE 17

| Sample | Used polymer solution:(138) Cleaning property | Image quality | Durability |
|---|---|---|---|
| 3-1 | ○ | ○ | ○ |
| 3-2 | ◎ | ○ | ○ |
| 3-3 | ○ | ○ | ○ |
| 3-4 | ○ | ○ | ◎ |
| 3-5 | ◎ | ◎ | ○ |
| 3-6 | ○ | ◎ | ○ |
| 3-7 | ○ | ○ | ○ |
| 3-8 | ○ | ○ | ○ |
| 3-9 | ○ | ◎ | ○ |
| 3-10 | ○ | ○ | ○ |
| 3-11 | ○ | ○ | ○ |
| 3-12 | ○ | ○ | ◎ |
| 3-13 | ○ | ○ | ○ |
| 3-14 | ○ | ◎ | ○ |
| 3-15 | ◎ | ◎ | ○ |
| 3-16 | ○ | ○ | ○ |
| 3-17 | ○ | ○ | ◎ |
| 3-18 | ◎ | ◎ | ○ |
| 3-19 | ○ | ○ | ○ |
| 3-20 | ○ | ○ | ○ |
| 3-21 | ○ | Δ | ○ |
| 3-22 | ○ | ○ | ○ |
| 3-23 | Δ | ○ | ○ |
| 3-24 | ○ | ○ | ○ |
| 3-25 | ○ | ◎ | ○ |
| 3-26 | ○ | ○ | ○ |
| 3-27 | ◎ | ○ | ○ |
| 4-1 | ○ | ○ | ○ |
| 4-2 | ○ | ○ | ○ |
| 4-3 | ◎ | ◎ | ◎ |
| 4-4 | ○ | ○ | ○ |
| 4-5 | ○ | ◎ | ○ |
| 4-6 | ○ | ○ | ○ |
| 4-7 | ○ | ○ | ○ |
| 4-8 | ○ | ○ | ○ |

TABLE 18

| Sample | Used polymer solution:(138) Cleaning property | Image quality | Durability |
|---|---|---|---|
| 5-1 | ◎ | ◎ | ○ |
| 5-2 | ◎ | ○ | ◎ |
| 5-3 | ◎ | ◎ | ◎ |
| 5-4 | ○ | ○ | ○ |
| 5-5 | ◎ | ○ | ○ |
| 5-6 | ○ | ○ | ◎ |
| 5-7 | ◎ | ○ | ○ |
| 5-8 | ○ | ○ | ◎ |
| 5-9 | ○ | ◎ | ○ |
| 5-10 | ◎ | ○ | ○ |
| 5-11 | ○ | ○ | ○ |
| 5-12 | ○ | ○ | ○ |
| 5-13 | ○ | ○ | ○ |

TABLE 18-continued

| Sample | Used polymer solution:(138) Cleaning property | Image quality | Durability |
|---|---|---|---|
| 5-14 | ◎ | ◎ | ○ |
| 5-15 | ○ | ○ | ○ |
| 5-16 | ○ | ○ | ◎ |
| 5-17 | ○ | Δ | ○ |
| 5-18 | ◎ | ○ | ○ |
| 5-19 | ○ | ○ | ○ |
| 5-20 | ○ | ○ | ◎ |
| 5-21 | ○ | ○ | ○ |
| 5-22 | ○ | ○ | ○ |
| 5-23 | ◎ | ○ | ○ |
| 5-24 | ○ | ○ | ○ |
| 5-25 | ◎ | ◎ | ○ |
| 5-26 | ○ | ○ | ○ |
| 5-27 | ◎ | ○ | ○ |
| 5-28 | ○ | ○ | ◎ |
| 5-29 | ○ | ○ | ○ |
| 5-30 | ○ | ○ | ○ |
| 5-31 | ○ | ◎ | ◎ |
| 5-32 | ○ | ○ | ○ |
| 5-33 | ○ | ○ | ○ |
| 5-34 | ○ | ◎ | ○ |
| 5-35 | ◎ | ◎ | ○ |

TABLE 19

| Sample | Used polymer solution:(138) Cleaning property | Image quality | Durability |
|---|---|---|---|
| 6-1 | ○ | ○ | ○ |
| 6-2 | ○ | ○ | ○ |
| 6-3 | ○ | ◎ | ○ |
| 6-4 | ○ | ◎ | ◎ |
| 6-5 | ○ | ○ | ○ |
| 6-6 | ○ | ○ | ○ |
| 6-7 | ○ | ○ | ○ |
| 6-8 | Δ | ○ | ◎ |
| 6-9 | ○ | ○ | ○ |
| 6-10 | ○ | ○ | ○ |
| 6-11 | ○ | ○ | ○ |
| 6-12 | ◎ | ○ | ○ |
| 6-13 | ○ | ○ | ○ |
| 6-14 | ○ | ○ | ○ |
| 6-15 | ◎ | ◎ | ○ |
| 6-16 | ○ | ○ | ○ |
| 6-17 | ○ | ○ | ○ |
| 6-18 | ○ | ○ | ○ |
| 6-19 | ◎ | ○ | ○ |
| 6-20 | ◎ | ○ | ○ |
| 6-21 | ○ | ○ | ○ |
| 6-22 | ○ | ○ | ○ |
| 6-23 | ○ | ○ | ○ |
| 6-24 | ○ | ○ | ○ |
| 6-25 | ○ | ○ | ○ |
| 6-26 | ○ | ○ | ○ |
| 6-27 | ○ | ◎ | ○ |
| 6-28 | ○ | ○ | ○ |
| 6-29 | ○ | ○ | Δ |
| 6-30 | ○ | ○ | ○ |
| 6-31 | ○ | ○ | ○ |
| 6-32 | ◎ | ◎ | ○ |
| 6-33 | ○ | ○ | ○ |
| 6-34 | ◎ | ○ | ○ |
| 6-35 | ◎ | ◎ | ○ |
| 6-36 | ○ | ○ | ○ |
| 6-37 | ○ | ○ | ○ |
| 6-38 | ○ | ○ | ○ |
| 6-39 | ○ | ○ | ○ |

TABLE 20

| Sample | Used polymer solution:(140) Cleaning property | Image quality | Durability |
|---|---|---|---|
| 2-1 | ○ | ◎ | ○ |
| 2-2 | ○ | ○ | ○ |

TABLE 20-continued

| Sample | Used polymer solution:(140) Cleaning property | Image quality | Durability |
|---|---|---|---|
| 2-3 | ◎ | ○ | ○ |
| 2-4 | ○ | ○ | ○ |
| 2-5 | ○ | ○ | ○ |
| 2-6 | ○ | ◎ | ○ |
| 2-7 | ○ | ○ | ○ |
| 2-8 | Δ | ○ | ○ |
| 2-9 | ◎ | ○ | ○ |
| 2-10 | ○ | ○ | ○ |
| 2-11 | ◎ | ○ | ○ |
| 2-12 | ○ | ○ | Δ |
| 2-13 | ○ | ○ | ○ |
| 2-14 | ○ | Δ | ○ |
| 2-15 | ○ | ○ | Δ |
| 2-16 | ○ | ○ | ○ |
| 2-17 | ◎ | ○ | ○ |
| 2-18 | ○ | ○ | ◎ |
| 2-19 | ○ | ◎ | ○ |
| 2-20 | ○ | ○ | ○ |
| 2-21 | ○ | ○ | ○ |
| 2-22 | ○ | ○ | ○ |
| 2-23 | ○ | ◎ | ○ |
| 2-24 | ○ | ○ | ○ |
| 2-25 | ○ | ○ | ○ |
| 2-26 | ○ | ◎ | ○ |
| 2-27 | ○ | ◎ | ○ |

TABLE 21

| Sample | Used polymer solution:(140) Cleaning property | Image quality | Durability |
|---|---|---|---|
| 3-1 | ○ | ◎ | ○ |
| 3-2 | ○ | ○ | ○ |
| 3-3 | ○ | ○ | ○ |
| 3-4 | ○ | ○ | ○ |
| 3-5 | ○ | ○ | ○ |
| 3-6 | ○ | ◎ | ○ |
| 3-7 | ○ | ○ | ○ |
| 3-8 | ○ | ○ | ○ |
| 3-9 | Δ | ○ | ○ |
| 3-10 | ○ | ○ | ○ |
| 3-11 | ○ | ○ | ○ |
| 3-12 | ○ | ○ | ○ |
| 3-13 | ○ | ○ | ○ |
| 3-14 | ○ | ○ | ○ |
| 3-15 | ○ | ○ | ○ |
| 3-16 | ◎ | ◎ | ◎ |
| 3-17 | ○ | ◎ | ○ |
| 3-18 | ○ | ○ | ○ |
| 3-19 | ○ | ○ | ○ |
| 3-20 | ○ | ○ | ○ |
| 3-21 | ◎ | ○ | ○ |
| 3-22 | ○ | ◎ | ○ |
| 3-23 | ○ | ○ | ○ |
| 3-24 | ○ | ○ | ○ |
| 3-25 | ○ | ○ | ○ |
| 3-26 | ○ | ◎ | ○ |
| 3-27 | ○ | ○ | ○ |

TABLE 22

| Sample | Used polymer solution:(140) Cleaning property | Image quality | Durability |
|---|---|---|---|
| 4-1 | ○ | ◎ | ○ |
| 4-2 | ○ | ○ | ○ |
| 4-3 | ◎ | ○ | ○ |
| 4-4 | ○ | ○ | ○ |
| 4-5 | ○ | ○ | ○ |
| 4-6 | ◎ | ◎ | ○ |
| 4-7 | ○ | ○ | ○ |
| 4-8 | ○ | ○ | ○ |

TABLE 23

| Sample | Used polymer solution:(140) Cleaning property | Image quality | Durability |
|---|---|---|---|
| 5-1 | ○ | ○ | ◎ |
| 5-2 | ○ | ◎ | ◎ |
| 5-3 | ○ | ○ | ○ |
| 5-4 | ○ | ○ | ○ |
| 5-5 | ◎ | ◎ | ○ |
| 5-6 | ○ | ○ | ○ |
| 5-7 | ○ | ○ | ○ |
| 5-8 | ○ | ○ | ○ |
| 5-9 | ○ | ◎ | ○ |
| 5-10 | ◎ | ◎ | ○ |
| 5-11 | ○ | ○ | ○ |
| 5-12 | ○ | ○ | ○ |
| 5-13 | ○ | ○ | ○ |
| 5-14 | Δ | ○ | ○ |
| 5-15 | ○ | ○ | ○ |
| 5-16 | ○ | ○ | ○ |
| 5-17 | ○ | ◎ | ◎ |
| 5-18 | ○ | ○ | ○ |
| 5-19 | ○ | ○ | ○ |
| 5-20 | ○ | ○ | ◎ |
| 5-21 | ○ | ○ | ○ |
| 5-22 | ◎ | ○ | ◎ |
| 5-23 | ○ | ○ | ○ |
| 5-24 | ○ | ○ | ○ |
| 5-25 | ○ | ◎ | ◎ |
| 5-26 | ○ | ○ | ○ |
| 5-27 | ○ | ○ | ○ |
| 5-28 | ○ | ○ | ○ |
| 5-29 | ○ | ◎ | ○ |
| 5-30 | ○ | ○ | ○ |
| 5-31 | ○ | ◎ | ○ |
| 5-32 | ○ | ◎ | ○ |
| 5-33 | ◎ | ◎ | ○ |
| 5-34 | ○ | ○ | Δ |
| 5-35 | ○ | ○ | ○ |

TABLE 24

| Sample | Used polymer solution:(140) Cleaning property | Image quality | Durability |
|---|---|---|---|
| 6-1 | ○ | ○ | ○ |
| 6-2 | ○ | ○ | ○ |
| 6-3 | ○ | ○ | ○ |
| 6-4 | ○ | ○ | ○ |
| 6-5 | ◎ | ◎ | ◎ |
| 6-6 | ○ | ○ | ○ |
| 6-7 | ○ | ○ | Δ |
| 6-8 | ○ | ○ | ○ |
| 6-9 | ◎ | ○ | ○ |
| 6-10 | ◎ | ◎ | ○ |
| 6-11 | ○ | ○ | ○ |
| 6-12 | ○ | ○ | ◎ |
| 6-13 | ○ | ○ | ○ |
| 6-14 | ○ | ○ | ○ |
| 6-15 | ◎ | ○ | ○ |
| 6-16 | Δ | ○ | Δ |
| 6-17 | ○ | ○ | ○ |
| 6-18 | ○ | ○ | ○ |
| 6-19 | ○ | ○ | ○ |
| 6-20 | ○ | ○ | ◎ |
| 6-21 | ○ | ○ | ◎ |
| 6-22 | Δ | ○ | ○ |
| 6-23 | ○ | ○ | ○ |
| 6-24 | ○ | ○ | ○ |
| 6-25 | ○ | ○ | ○ |
| 6-26 | ◎ | ○ | ○ |
| 6-27 | ○ | ○ | ◎ |
| 6-28 | ○ | ○ | ○ |
| 6-29 | ○ | ○ | ○ |
| 6-30 | ○ | ○ | ○ |
| 6-31 | ○ | ○ | ○ |
| 6-32 | ○ | ◎ | ○ |
| 6-33 | ○ | ○ | ○ |
| 6-34 | ○ | ◎ | ○ |
| 6-35 | ○ | ○ | ○ |
| 6-36 | Δ | ○ | ○ |

TABLE 24-continued

| Sample | Used polymer solution:(140) Cleaning property | Image quality | Durability |
|---|---|---|---|
| 6-37 | ○ | ○ | ○ |
| 6-38 | ◎ | ◎ | ○ |
| 6-39 | ○ | ○ | ○ |

TABLE 25

| Sample | Used polymer solution:(141) Cleaning property | Image quality | Durability |
|---|---|---|---|
| 2-1 | ○ | ◎ | ○ |
| 2-2 | ○ | ○ | ○ |
| 2-3 | ○ | ○ | ○ |
| 2-4 | ○ | ○ | ○ |
| 2-5 | ○ | Δ | ○ |
| 2-6 | ○ | ○ | ○ |
| 2-7 | ○ | ◎ | ○ |
| 2-8 | ○ | ○ | ○ |
| 2-9 | ○ | ○ | ○ |
| 2-10 | ○ | ○ | Δ |
| 2-11 | ○ | ○ | ○ |
| 2-12 | Δ | ○ | ○ |
| 2-13 | ○ | ○ | ○ |
| 2-14 | ○ | ◎ | ○ |
| 2-15 | ○ | ◎ | ○ |
| 2-16 | ○ | ○ | ○ |
| 2-17 | ○ | ○ | ○ |
| 2-18 | ○ | ○ | ○ |
| 2-19 | ○ | ○ | ○ |
| 2-20 | ○ | ○ | ○ |
| 2-21 | ○ | ○ | ○ |
| 2-22 | ○ | Δ | ○ |
| 2-23 | ○ | ◎ | Δ |
| 2-24 | ○ | ○ | ○ |
| 2-25 | ○ | ○ | ○ |
| 2-26 | ○ | ○ | ○ |
| 2-27 | ○ | ○ | ○ |

TABLE 26

| Sample | Used polymer solution:(141) Cleaning property | Image quality | Durability |
|---|---|---|---|
| 3-1 | ◎ | ○ | ○ |
| 3-2 | ○ | ○ | ○ |
| 3-3 | ◎ | ◎ | ○ |
| 3-4 | Δ | ○ | ○ |
| 3-5 | ○ | ○ | ○ |
| 3-6 | ○ | ○ | ○ |
| 3-7 | ◎ | ○ | ◎ |
| 3-8 | ○ | ○ | ○ |
| 3-9 | ○ | ○ | ○ |
| 3-10 | ○ | ○ | Δ |
| 3-11 | ◎ | Δ | ○ |
| 3-12 | ○ | ○ | ○ |
| 3-13 | ○ | ◎ | ○ |
| 3-14 | ◎ | ○ | ◎ |
| 3-15 | ○ | Δ | ○ |
| 3-16 | ○ | ○ | ○ |
| 3-17 | ○ | ○ | ○ |
| 3-18 | Δ | ○ | ○ |
| 3-19 | ○ | ◎ | ○ |
| 3-20 | ○ | ○ | ○ |
| 3-21 | ○ | ◎ | ○ |
| 3-22 | ○ | ○ | ○ |
| 3-23 | ○ | ◎ | ◎ |
| 3-24 | ◎ | ○ | ○ |
| 3-25 | ◎ | ○ | ◎ |
| 3-26 | ○ | ○ | ○ |
| 3-27 | ○ | ○ | ○ |

TABLE 27

| Sample | Used polymer solution:(141) Cleaning property | Image quality | Durability |
|---|---|---|---|
| 4-1 | ○ | ○ | ○ |
| 4-2 | ○ | ◎ | ○ |
| 4-3 | ◎ | ◎ | ◎ |
| 4-4 | ○ | ○ | ○ |
| 4-5 | ○ | ◎ | ○ |
| 4-6 | ○ | ○ | ○ |
| 4-7 | ○ | ○ | ○ |
| 4-8 | ○ | ○ | ○ |

TABLE 28

| Sample | Used polymer solution:(141) Cleaning property | Image quality | Durability |
|---|---|---|---|
| 5-1 | ○ | ○ | ◎ |
| 5-2 | ◎ | ○ | ◎ |
| 5-3 | ○ | ○ | ○ |
| 5-4 | ◎ | ◎ | ○ |
| 5-5 | ○ | ○ | ○ |
| 5-6 | ○ | ○ | ○ |
| 5-7 | ○ | ○ | ○ |
| 5-8 | ○ | ○ | ○ |
| 5-9 | ○ | ◎ | ○ |
| 5-10 | ◎ | ○ | ○ |
| 5-11 | ○ | ○ | ○ |
| 5-12 | ○ | ○ | ○ |
| 5-13 | ○ | ○ | ◎ |
| 5-14 | ○ | Δ | ◎ |
| 5-15 | ○ | ○ | ○ |
| 5-16 | ○ | ○ | ○ |
| 5-17 | ○ | ○ | ○ |
| 5-18 | ◎ | ○ | ○ |
| 5-19 | ○ | ○ | ○ |
| 5-20 | ○ | ○ | ○ |
| 5-21 | ○ | ○ | ○ |
| 5-22 | ○ | ○ | ○ |
| 5-23 | ○ | ○ | ◎ |
| 5-24 | ○ | ○ | ○ |
| 5-25 | ○ | ○ | ○ |
| 5-26 | ○ | ○ | ◎ |
| 5-27 | Δ | ○ | ○ |
| 5-28 | ○ | ○ | ○ |
| 5-29 | ○ | ○ | ◎ |
| 5-30 | ○ | ○ | ○ |
| 5-31 | ○ | ○ | ◎ |
| 5-32 | ○ | ◎ | ○ |
| 5-33 | ○ | ○ | ◎ |
| 5-34 | ○ | ◎ | ◎ |
| 5-35 | ◎ | ○ | ○ |

TABLE 29

| Sample | Used polymer solution:(141) Cleaning property | Image quality | Durability |
|---|---|---|---|
| 6-1 | ◎ | ◎ | ○ |
| 6-2 | ○ | ○ | ◎ |
| 6-3 | ○ | ○ | ○ |
| 6-4 | ○ | ○ | ○ |
| 6-5 | ○ | ○ | ○ |
| 6-6 | ○ | ○ | ○ |
| 6-7 | ○ | Δ | ○ |
| 6-8 | ○ | ○ | ○ |
| 6-9 | ○ | ○ | ○ |
| 6-10 | ○ | ○ | ○ |
| 6-11 | ○ | ○ | ○ |
| 6-12 | ◎ | ◎ | ○ |
| 6-13 | ○ | ◎ | ○ |
| 6-14 | ○ | ○ | ○ |
| 6-15 | ○ | ○ | ○ |
| 6-16 | ○ | ○ | ○ |
| 6-17 | ○ | ○ | ○ |
| 6-18 | ○ | ○ | ○ |
| 6-19 | ◎ | ○ | ○ |
| 6-20 | ○ | ○ | ○ |

TABLE 29-continued

| Sample | Used polymer solution:(141) Cleaning property | Image quality | Durability |
|---|---|---|---|
| 6-21 | ○ | ○ | ○ |
| 6-22 | ○ | ○ | ○ |
| 6-23 | Δ | ○ | ○ |
| 6-24 | ○ | ○ | ○ |
| 6-25 | ○ | ○ | ○ |
| 6-26 | ◎ | ○ | ◎ |
| 6-27 | ○ | ○ | ○ |
| 6-28 | ○ | ○ | ○ |
| 6-29 | ○ | ○ | Δ |
| 6-30 | ○ | ○ | ○ |
| 6-31 | ○ | ○ | ○ |
| 6-32 | ○ | ◎ | ○ |
| 6-33 | ○ | ○ | ◎ |
| 6-34 | ○ | ◎ | ○ |
| 6-35 | ○ | ○ | ○ |
| 6-36 | ○ | ○ | ○ |
| 6-37 | ○ | ◎ | ◎ |
| 6-38 | ○ | ○ | ○ |
| 6-39 | ○ | ○ | ◎ |

EXAMPLE 21

An electroconductivity imparting agent, compound (147) was coated onto the back surface of the art paper, in other words, the opposite side to the organic silver salt layer, of each of Samples (2-1), (2-7), (2-19), (3-1), (3-7), (3-15), (4-3), (4-8), (5—5), (5-19), (5-29), (6-2), (6-22) and (6-38) in accordance with the procedure of Example 7 to prepare a heat-developable photosensitive material for producing an electrostatic printing master. It was tested in the same manner as in Example 2 whether or not each photosensitive material was suitable for an electrostatic printing master. As the result, it was found that each master was excellent in the uniformity of development and small in the fog density in the image-receiving paper and further sufficiently high in the electrostatic potential contrast between the image portion and the non-image portion as shown in Table-30.

TABLE 30

| Sample | Electroconductivity imparting solution (147) Development uniformity | Fog density* | Electrostatic potential contrast |
|---|---|---|---|
| 2-1 | ○ | 0.10 | 420 |
| 2-7 | Δ | 0.10 | 400 |
| 2-19 | ○ | 0.10 | 410 |
| 3-1 | ○ | 0.11 | 430 |
| 3-7 | ○ | 0.10 | 400 |
| 3-15 | ◎ | 0.12 | 450 |
| 4-3 | ○ | 0.10 | 440 |
| 4-8 | ○ | 0.11 | 390 |
| 5-5 | ○ | 0.10 | 490 |
| 5-19 | ○ | 0.10 | 470 |
| 5-29 | ○ | 0.10 | 460 |
| 6-2 | ○ | 0.11 | 460 |
| 6-22 | ◎ | 0.11 | 490 |
| 6-38 | ◎ | 0.10 | 450 |

Note:
*Fog density is that on the image-receiving paper.
Very good
Good
Δ Somewhat good

EXAMPLE 22

An electroconductivity imparting agent, compound (148) was coated onto the back surface of the art paper, in other words, the opposite side to the organic silver salt layer, of each of Sample (7-2) in accordance with the procedure of Example 7 to prepare a heat-developable photosensitive material for producing an electrostatic printing master (Sample 21-1). It was tested in the same manner as in Example 2 whether or not Sample 21-1 was suitable for an electrostatic printing master. As shown Table-31, a good result was obtained.

EXAMPLE 23

An electroconductivity imparting agent, compound (146) was coated onto the back surface of the art paper, in other words, the opposite side to the organic silver salt layer, of each of Sample (7-5) in accordance with the procedure of Example 7 to prepare a heat-developable photosensitive material for producing an electrostatic printing master (Sample 22-1). It was tested in the same manner as in Example 2 whether or not Sample 22-1 was suitable for an electrostatic printing master. As shown in Table-31, a good result was obtained.

EXAMPLE 24

An electroconductivity imparting agent, compound (149) was coated onto an art paper in the same manner as in Example 7 to form an electroconductive layer. Compositions A-2 and B-2 used in Example 7 were coated onto the electroconductive layer in the same manner as in Example 7 to form an organic silver salt layer and an over-coating layer. Polymer solution (137) was then coated onto the over-coating layer in the same manner as in Example 6 to prepare a heat-developable photosensitive material for producing an electrostatic printing master (Sample 23-1). It was tested in the same manner as in Example 2 whether or not Sample 23-1 was suitable for the electrostatic printing so that a good result was obtained as shown in Table-31.

TABLE 31

| Sample | Development uniformity | Fog density* | Electrostatic potential contrast |
|---|---|---|---|
| 21-1 | ◎ | 0.10 | 480 |
| 22-1 | ○ | 0.11 | 500 |
| 23-1 | ○ | 0.10 | 480 |

Note:
*Fog density on the image-receiving paper
◎ Very Good
○ Good

EXAMPLE 25

20 g. of silver behenate, 150 g. of methyl ethyl ketone and 150 g. of toluene were mixed and dispersed for 72 hours by the ball milling method to prepare a uniform slurry. 100 g. of 20% ethyl alcohol solution of polyvinyl butyral resin (S-Lec BM-1, trade name, manufactured by Sekisui Chemical Co.) was then added to the slurry and gently mixed for about three hours. Further, 0.12 g. of mercury acetate, 0.2 g. of calcium bromide and 0.5 g. of phthalazinone were added. The polymer dispersion liquid thus prepared was uniformly coated onto an art paper having a thickness of 80μ by a coating rod and dried at 80° C. for three minutes to form an organic silver salt layer.

Furthermore, the following mixture:

| | |
|---|---|
| 2,2'-methylene-bis-6-t-butyl-p-cresol | 1.5 g. |
| Phthalazinone | 0.3 g. |
| 10% acetone solution of cellulose acetate L-30 (trade name, supplied by DAICEL Ltd.) | 10 g. |
| Acetone | 30 g. |
| 3,3'-diethyl-2,2'-thia-carbocyanine iodide | 0.005 g. |
| Powder (average particle size 50 mμ) of ethylene trifluorochloride resin (supplied by Mitsui Fluorochemical K.K.) | 0.05 g. |

was coated onto the foregoing organic silver salt layer.

The photosensitive material (Sample-I) thus prepared was exposed to a tungsten light source (2500 lux) through a positive image for 12 seconds, and heat development was conducted by a roller heating device at 130° C. for two seconds to obtain a negative print visible image.

On the other hand, for comparison, the photosensitive material (Sample-II) prepared in the same manner as above except that ethylene trifluorochloride resin was not used, was subjected to the same exposure and heat development to obtain a visible image.

There was not a large difference in the characteristics required for a heat-developable photosensitive material between Samples-I and II.

These samples were attached to a drum which was then rotated at a peripheral speed of 600 mm/sec. to conduct the charging, developing, transferring and blade cleaning, and the surface of the samples was examined. As the result, as abrasion (its number which occurred in the width of 10 cm) was observed as shown in Table-32.

TABLE 32

| After Drum was rotated | Sample-I | Sample-II |
|---|---|---|
| 3 min. after | 0 | 5 |
| 5 min. after | 0 | 10 |
| 10 min. after | 0 | 40 |
| 20 min. after | 3 | 200 |
| 60 min. after | 7 | Measuring impossible |

Therefore, it was recognized that the damage in the master surface caused by the toner particle, carrier particle and blade was remarkably reduced by the addition of the foregoing resin powder.

What we claim is:

1. A process for electrostatic printing comprising the steps of:

(a) imagewise exposing a heat-developable photosensitive member which comprises:

a support having a resistance of not higher than $10^9$ Ω·cm.;

an organic silver salt layer (B) comprising an organic silver salt (a), a halide (b), a toning agent (c) dispersed in an electrically insulating resinous binder (d), said organic silver salt layer, when treated by a process including exposure to image light, provides a silver image portion corresponding to said image light, said silver image portion having a specific resistance $\rho 1$ less than $10^{13}$ Ω·cm., the remaining portion of said layer having a specific resistance $\rho 2$ more than $10^{11}$ Ω·cm., and $\rho 1$ is less than $\rho 2$ by a factor of two powers of ten or more, said organic silver salt layer having a thickness of from 1-50 microns sufficient to form an exposed silver portion adapted to give sufficient contrast and image for use as a master in electrophotography; and a surface protecting layer (C) having a thickness of from 0.5-15 microns having substantially no charge retentivity, having a high property of development and a high cleaning property upon electrostatic printing, and directly or with an intervening layer, overlying the organic silver salt layer (B);

a reducing agent (E) being contained in the organic silver salt layer (B), or at least one layer adjacent to the organic silver salt layer (B), or the organic silver salt layer (B) and at least one layer adjacent to the organic silver salt layer (B) and a stabilizer (g) being contained in an amount of from $2-10^{-7}$ mole per one mole of said organic silver salt (a) in the organic silver salt layer (B), or at least one layer adjacent to the organic silver salt layer (B), or the organic silver salt layer (B) and at least one layer adjacent to the organic silver salt layer (B) to form a latent silver image thereon, (b) heat developing said latent silver image to form a silver image, (c) employing said developed member as an electrostatic printing master by forming on electrostatic latent image thereon, (d) developing said electrostatic latent image and (e) transferring said developed image to an image receiving sheet.

2. The process of claim 1 including the step of cleaning the surface of said master after transferring said developed image.

3. The process claim 1 including repeating steps (c), (d), and (e).

4. The process of claim 1 including repeating steps (d) and (e).

5. The process of claim 1 including the steps of transferring said developed image to an image receiving sheet by a charging transfer.

6. The process of claim 5 including repeating said charging transfer step and said developing step to provide a plurality of copies.

7. The process of claim 2 including repeating steps (d) and (e) to provide a plurality of copies.

8. A process for electrostatic printing comprising the steps of:

(a) imagewise exposing a heat-developable photosensitive member which comprises:

a support (A) having a specific resistance of not higher than $10^9$ Ω·cm.;

an organic silver salt layer (B) comprising an organic silver salt (a), a halide (b) and a toning agent (c) dispersed in an electrically insulating resinous binder (d), said organic silver salt layer, when treated by a process including exposure to image light, provides a silver image portion corresponding to said image light, said silver image portion having a specific resistance $\rho 1$ less than $10^{13}$ Ω·cm., the remaining portion of said layer having a specific resistance $\rho 2$ more than $10^{11}$ Ω·cm., and $\rho 1$ is less than $\rho 2$ by a factor of two powers of ten or more, said organic silver salt layer having a thickness of from 1–50 microns sufficient to form an exposed silver portion adapted to give sufficient contrast and image for use as a master in electrophotography; and a surface protecting layer (C) having a thickness of from 0.5–15 microns having substantially no charge retentivity, having a high property of development and a high cleaning property upon electrostatic printing, and directly or with an intervening layer, overlying the organic silver salt layer (b);

reducing agent (e) being contained in the organic silver salt layer (B), or at least one layer adjacent to the organic silver salt layer (B), or the organic silver salt layer (B) and at least one layer adjacent to the organic silver salt layer (B), and a light resistant agent (h) being contained in an amount of from $2-10^{-7}$ mole per mole of said organic silver salt (a) in the organic silver salt layer (B), or at least one layer adjacent to the organic silver salt layer (B), or the organic silver salt layer (B) and at least one layer adjacent to the organic silver salt layer (B) to form a latent silver image thereon, (b) heat developing said latent silver image to form a silver image, (c) employing said developed member as an electrostatic printing master by forming an electrostatic latent image thereon, (d) developing said electrostatic latent image and (e) transferring said developed image to an image receiving sheet.

9. A process for electrostatic printing comprising the steps of:

(a) imagewise exposing a heat-developable photosensitive member for forming an electrostatic printing master which comprises:

a support (A) having a specific resistance of not higher than $10^9$ Ω·cm.;

an organic silver salt layer (B) comprising an organic silver salt (a), a halide (b) and a toning agent (c) dispersed in an electrically insulating resinous binder (d), said organic silver salt layer, when treated by a process including exposure to image light, provides a silver image portion corresponding to said image light, said silver image portion having a specific resistance $\rho 1$ less than $10^{13}$ Ω·cm., the remaining portion of said layer having a specific resistance $\rho 2$ more than $10^{11}$ Ω·cm., and $\rho 1$ is less than $\rho 2$ by a factor of two powers of ten or more, said organic silver salt layer having a thickness of from 1–50 microns sufficient to form an exposed silver portion adapted to give sufficient contrast and image for use as a master in electrophotography; and a surface of a high mechanical, electrostatic and repeating durability, a high property of development and a high cleaning property, and a reducing agent (e) being contained in the organic silver salt layer (B), or at least one layer adjacent to the organic silver salt layer (B), or the organic silver salt layer (B) and at least one layer adjacent to the organic silver salt layer (B), and a stabilizer (g) being contained in an amount of from $2-10^{-7}$ mole per mole of said organic silver salt (a) in the organic silver salt layer (b), or at least one layer adjacent to the organic silver salt layer (B), or the organic silver salt layer (B) and at least one layer adjacent to the organic silver salt layer (B) to form a latent silver image thereon, (b) heat developing said latent silver image to form a silver image, (c) employing said developed member as an electrostatic printing master by forming on electrostatic latent image thereon, (d) developing said electrostatic latent image and (e) transferring said developed image to an image receiving sheet.

10. A process for electrostatic printing comprising the steps of:

(a) imagewise exposing a heat-developable photosensitive member for forming an electrostatic printing master which comprises:

a support (A) having a specific resistance of not higher than $10^9$ Ω·cm.;

an organic silver salt layer (B) comprising an organic silver salt (a), a halide (b) and a toning agent (c) dispersed in an electrically insulating resinous binder (d), said organic silver salt layer, when treated by a process including exposure to image light, provides a silver image portion corresponding to said image light, said silver image portion having a specific resistance p1 less than $10^{13}$ Ω·cm., the remaining portion of said layer having a specific resistance $\rho 2$ more than $10^{11}$ Ω·cm., and $\rho 1$ is less than $\rho 2$ by a factor of two powers of ten or more, said organic silver salt layer having a thickness of from 1–50 microns sufficient to form an exposed silver portion adapted to give sufficient contract and image for use as a master in electrophotography; and a surface of a high mechanical, electrostatic and repeating durability, a high property of development and a high cleaning property, a reducing agent (e) being contained in the organic silver salt layer (B), or at least one layer adjacent to the organic silver salt layer (B), or the organic silver salt layer (B) and at least one layer adjacent to the organic silver salt layer (B), and a light resistant agent (h) being contained in an amount of from $2\text{–}10^{-7}$ mole per mole of said organic silver salt (a) in the organic silver salt layer (B), or at least one layer adjacent to the organic silver salt layer (B), or the organic silver layer (B), and at least one layer adjacent to the organic silver salt layer (B) to form a latent silver image thereon, (b) heat developing said latent silver image to form a silver image, (c) employing said developed member as an electrostatic printing master by forming on electrostatic latent image thereon, (d) developing said electrostatic latent image and (e) transferring said developed image to an image receiving sheet.

* * * * *

UNITED STATES PATENT AND TRADEMARK OFFICE

CERTIFICATE OF CORRECTION

PATENT NO. : 4,273,844

DATED : June 16, 1981

INVENTOR(S) : HAJIME KOBAYSHI, ET AL.

It is certified that error appears in the above-identified patent and that said Letters Patent is hereby corrected as shown below:

Column 6, line 38, "α,α'" second occurrence should be -- "β,β'"--
Column 8, line 49, delete -- Sho --.
Column 14, line 41,

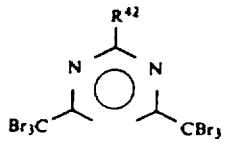

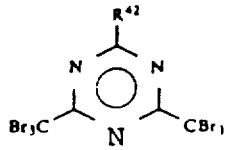

Column 14, line 1, delete -- N --.
Column 19, line 62, "purpose accelerating" should be -- purpose of accelerating --.
Column 20, line 1, "serves" should be -- serve --.
Column 21, line 18, "of" should be -- on --.
Column 22, line 38, "of layers" should be -- of the layers --.
Column 25, line 23, "may formed" should be -- may be formed --.
Column 25, line 27, "embodiment" should be -- embodiments --.
Column 28, line 46, "Agent" should be -- Agents --.

UNITED STATES PATENT AND TRADEMARK OFFICE

CERTIFICATE OF CORRECTION

PATENT NO. : 4,273,844

DATED : June 16, 1 981

INVENTOR(S) : HAJIME KOBAYSHI, ET AL.

It is certified that error appears in the above-identified patent and that said Letters Patent is hereby corrected as shown below:

Column 29, line 2, "Agent" should be -- Agents --.

Column 32, line 32-41,

" 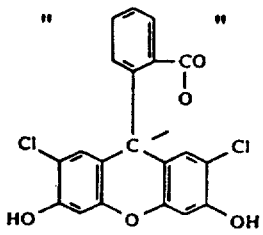 " should be -- 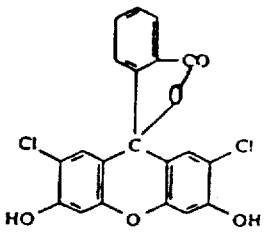 --

Column 36, line 4, "was excellent one" should be -- was an excellent one --.

Column 36, line 6, "with faithful with" should be -- faithfully with --.

Column 38, line 3, "silver behenate" should be -- silver behanate*1 --.

Column 44, line 8, "compositions A-4" should be -- composition A-4 --.

Column 45, line 68, "art upper" should be -- art paper --.

Column 47, line 65, "was excellent one" should -- was an excellent one --.

Column 49, line 33, "(3-1) - (3027)" should be -- (3-1) - (3-27) --

UNITED STATES PATENT AND TRADEMARK OFFICE

CERTIFICATE OF CORRECTION

PATENT NO. : 4,273,844

DATED : June 16, 1981

INVENTOR(S) : HAJIME KOBAYSHI, ET AL.

It is certified that error appears in the above-identified patent and that said Letters Patent is hereby corrected as shown below:

Column 50, line 36, in Table 17, "3-16 o o o" should be -- 3-16 ◎ o o --.
Column 56, line 54, in Table 30, "5-5 o 0.10" should be -- 5-5 ◎ 0.10 --.
Column 56, line 53, in Table 30, "5-19 o 0.10" should be -- 5-5 ◎ 0.10 --.
Column 56, line 58, in Table 30, "6-38 ◎ 0.10" should be -- 6-38 o 0.10 --.
Column 56, line 59-60,

| | | |
|---|---|---|
| "Very good " | should be -- | ◎...Very good -- |
| Good | | o...Good |
| △Somewhat good | | △...Somewhat good -- |

Column 57, line 6, "As shown Table" should be -- As shown in Table --.
Column 61, line 10, in the claims, "pl" should be -- ρl --.
Column 62, line 16, "forming on", should be -- forming an --.

Signed and Sealed this

*Twenty-ninth* Day of *March 1983*

[SEAL]

*Attest:*

GERALD J. MOSSINGHOFF

*Attesting Officer* *Commissioner of Patents and Trademarks*